US009267192B2

(12) United States Patent
Schmidt et al.

(10) Patent No.: US 9,267,192 B2
(45) Date of Patent: Feb. 23, 2016

(54) PROCESSABLE HIGH THERMAL NEUTRON ABSORBING FE-BASE ALLOY POWDER

(75) Inventors: Michael L. Schmidt, Sinking Spring, PA (US); Gregory J. Del Corso, Reading, PA (US); Patrick C. Ray, Coatesville, PA (US); Ning Ma, Whitehouse, NJ (US)

(73) Assignee: CRS HOLDINGS, INC., Wilmington, DE (US)

( * ) Notice: Subject to any disclaimer, the term of this patent is extended or adjusted under 35 U.S.C. 154(b) by 746 days.

(21) Appl. No.: 13/217,784

(22) Filed: Aug. 25, 2011

(65) Prior Publication Data

US 2013/0047786 A1 Feb. 28, 2013

(51) Int. Cl.

| | |
|---|---|
| ***C22C 38/40*** | (2006.01) |
| ***C22C 38/44*** | (2006.01) |
| ***C22C 38/58*** | (2006.01) |
| ***C22C 38/54*** | (2006.01) |
| ***C22C 33/02*** | (2006.01) |
| ***C22C 38/00*** | (2006.01) |
| ***C22C 38/02*** | (2006.01) |
| ***G21F 1/08*** | (2006.01) |

(52) U.S. Cl.

CPC ..... *C22C 33/0285* (2013.01); *C22C 38/002* (2013.01); *C22C 38/005* (2013.01); *C22C 38/02* (2013.01); *C22C 38/44* (2013.01); *C22C 38/54* (2013.01); *C22C 38/58* (2013.01); *G21F 1/08* (2013.01); *B22F 2998/10* (2013.01)

(58) Field of Classification Search

CPC ..... C22C 38/44; C22C 38/60; C22C 38/58; C22C 32/0073; C22C 33/0285; C22C 38/54; C22C 38/002; C22C 38/005; C22C 38/02; B22F 2998/10; B22F 9/082; B22F 3/15; B22F 3/18; B22F 2003/248; G21F 1/08

USPC ..... 75/244; 420/44, 46, 52, 43

See application file for complete search history.

(56) References Cited

U.S. PATENT DOCUMENTS

| | | | |
|---|---|---|---|
| 3,362,813 | A | 1/1968 | Ziolkowski |
| 4,891,080 | A | 1/1990 | Del Corso et al. |
| 5,017,437 | A | 5/1991 | Martin et al. |
| 5,820,818 | A | 10/1998 | Kajimura |
| 6,125,912 | A | 10/2000 | Branagan et al. |
| 6,730,180 | B1 | 5/2004 | Mizia et al. |

FOREIGN PATENT DOCUMENTS

| | | |
|---|---|---|
| JP | 62-056557 | 3/1987 |
| JP | 50255812 | 10/1993 |
| JP | 06-192792 | 7/1994 |
| JP | 09111414 | 4/1997 |
| JP | 2827798 | 11/1998 |

OTHER PUBLICATIONS

English Abstract and English Machine Translation of Kajimura (JP 09-111414) (Apr. 28, 1997).*
PCT/US2011/049113, ISR, Nov. 2, 2011.
PCT/US2011049113, Written Opinion of the International Searching Authority, Nov. 2, 2011.

* cited by examiner

*Primary Examiner* — Jessee Roe
(74) *Attorney, Agent, or Firm* — Dann, Dorfman, Herrell and Skillman, P.C.

(57) ABSTRACT

A corrosion resistant, neutron absorbing, austenitic alloy powder is disclosed having the following composition in weight percent.

| | |
|---|---|
| C | 0.08 max. |
| Mn | up to 3 |
| Si | up to 2 |
| P | 0.05 max. |
| S | 0.03 max. |
| Cr | 17-27 |
| Ni | 11-20 |
| Mo + (W/1.92) | up to 5.2 |
| $B_{Eq}$ | 0.78-13.0 |
| O | 0.1 max. |
| N | up to 0.2 |
| Y | less than 0.005 |

The alloy contains at least about 0.25% B, at least about 0.05% Gd, and the balance of the alloy composition is iron and usual impurities. $B_{Eq}$ is defined as % B+4.35×(% Gd). An article of manufacture made from consolidated alloy powder is also disclosed which is characterized by a plurality of boride and gadolinide particles dispersed within a matrix. The boride and gadolinide particles are predominantly $M_2B$, $M_3B_2$, $M_3X$, and $M_5X$ in form, where X is gadolinium or a combination of gadolinium and boron and M is one or more of the elements silicon, chromium, nickel, molybdenum, iron.

25 Claims, 13 Drawing Sheets

Heat 046

Heat 046

Heat 881

Heat 866

Heat 047

Heat 048

Heat 048

Heat 869

Heat 049

Heat 049

Heat 870

Heat 050

Heat 868

PROCESSABLE HIGH THERMAL NEUTRON ABSORBING FE-BASE ALLOY POWDER

BACKGROUND OF THE INVENTION

1. Field of the Invention

The invention relates generally to neutron absorbing alloys, and in particular to an iron base alloy and an article of manufacture made from said alloy that can be processed to provide a unique combination of mechanical properties, corrosion resistance, and thermal neutron absorbability.

2. Description of the Related Art

Boron-containing stainless steels are used by the nuclear power industry for the storage, transportation, and control of radioactive materials. The suitability of this type of material in those applications is related to the increased thermal neutron absorption capability provided by the addition of boron, specifically the $B^{10}$ isotope, to the base material. An example of such a material is a modified Type 304 stainless steel sold under the registered trademark MICRO-MELT® NEUTROSORB PLUS® and described and claimed in U.S. Pat. Nos. 4,891,080 and 5,017,437. Boron may be present in that material as natural boron, which contains approximately 18.3 weight percent $B^{10}$ isotope (the balance being the $B^{11}$ isotope), enriched boron, or a combination thereof. Applications for the known material in the nuclear power industry include wet spent fuel storage racks, baskets for spent fuel dry storage transportation casks, reactor control rods, burnable poison, and neutron shielding plates. The rising costs associated with natural gas and petroleum as well as the environmental issues surrounding the use of coal in the generation of electricity have sparked a renewed interest world-wide in the use of nuclear power to augment the use of fossil fuels to generate electric power. The waste products generated by current and future nuclear power plants will need to be stored either on-site or at regional or national repositories. The benefit provided by boron to the nuclear power industry is related to its effect of increasing a material's thermal neutron absorption cross-section. Higher boron loads or the use of alternative neutron absorbers by themselves or when coupled with boron could provide a technical and marketing advantage for many articles used in these applications.

Boron is the traditional standard bearer for neutron absorption in containment materials. Although boron has only the sixth largest thermal neutron cross-section of all naturally occurring materials, its low atomic mass makes it the second most effective alloying addition on a weight percent basis. All of the neutron absorption capabilities of boron are derived from the $B^{10}$ isotope. However, $B^{10}$ enriched boron is generally cost prohibitive for use in commercial alloy systems, and as such, natural boron is normally used. Boron has little or no solubility in stainless steel or nickel-based alloys. Instead, it generally forms borides that are enriched with Cr, Mo and Fe. For example, in the MICRO-MELT NEUTROSORB PLUS alloy an $M_2B$ phase forms with a composition of about 46% Cr, 40% Fe, 3.5% Mn, 1.0% Ni and 9.5% B.

Boron additions to austenitic stainless steels result in improved neutron absorption characteristics, increased hardness, yield strength and tensile strength, but reduced tensile ductility, impact toughness, and corrosion resistance. The reduced corrosion resistance results from a depletion of matrix Cr as a result of the formation of the Cr-rich $M_2B$ phase. Typically, boron-containing stainless steels have not been used as structural components in the United States because of the toughness and ductility limitations that are usually associated with the use of boron additions in conventionally processed alloys. Through the use of alloy modifications and powder metallurgy processing, MICRO-MELT NEUTROSORB PLUS alloys minimize the reductions in corrosion resistance, ductility, and impact toughness that are associated with the addition of boron to conventional Type 304 stainless steel. The MICRO-MELT® NEUTROSORB PLUS® alloys contain up to 2.25% B and are covered by ASTM A887 Grade "A", while conventionally processed materials are covered by ASTM A887 Grade "B". Some steel producers will not sell cast and wrought borated stainless steels with B contents higher than about 1.85%. This is related to the fact that there are significant processing issues with conventional cast and wrought borated stainless steels containing more than this amount of B. Such processing issues include cracking and tearing of the alloy material when it is mechanically hot worked. The powder metallurgy (P/M) borated stainless steels sold under the MICRO-MELT NEUTROSORB PLUS and MICRO-MELT NEUTROSORB trademarks offer the opportunity to provide customers with a higher neutron absorption capability as a result of the reduced segregation associated with P/M produced material. However, there is a limit of nominally 3.5% boron that can be added to NEUTROSORB PLUS alloys and still have a processable alloy (i.e., one that can be hot worked into plate or bar). In addition, if the amount of B can be reduced through the use of a second and stronger neutron attenuating material, then a higher B equivalency ($B_{Eq}$) can be obtained in P/M processed alloys.

The NEUTROSORB PLUS alloys contain enriched $B^{10}$ or enriched $B^{10}$ plus natural B to obtain $B_{Eq}$ values higher than what would be attainable by using only natural B. Enriched $B^{10}$ is, however, very expensive (on the order of $1600/lb), which makes using it not cost effective in many applications. Use of a non-enriched element that has a higher $B_{Eq}$ than natural B and that is significantly less expensive than enriched $B^{10}$ would be preferred.

SUMMARY OF THE INVENTION

The disadvantages associated with the known corrosion resistant, neutron absorbing alloys are solved to a large degree by the material in accordance with the present invention. In accordance with a first aspect of the present invention there is provided a corrosion-resistant, austenitic alloy powder having the following composition in weight percent.

| | |
|---|---|
| C | 0.08 max. |
| Mn | up to 3 |
| Si | up to 2 |
| P | 0.05 max. |
| S | 0.03 max. |
| Cr | 17-27 |
| Ni | 11-20 |
| Mo + (W/1.92) | up to 5.2 |
| $B_{Eq}$ | 0.78-13.0 |
| O | 0.1 max. |
| N | up to 0.2 |
| Y | less than 0.005 |

The balance of the alloy composition is iron and usual impurities. $B_{Eq}$ is defined as % B+4.35×(% Gd) and the alloy contains at least about 0.25% B and at least about 0.05% Gd.

In accordance with another aspect of the present invention, there is provided an article of manufacture made from consolidated alloy powder having the weight percent composition set forth above. The powder metallurgy article according to this invention also includes a plurality of boride and gadolinide particles dispersed within a matrix. The boride and gadolinide particles are predominantly $M_2B$, $M_3B_2$, $M_5X$, and $M_3X$ in form where X is gadolinium or a combination of gadolinium and boron and M is selected from the group consisting of silicon, chromium, nickel, molybdenum, iron, and combinations thereof.

An alloy and articles made therefrom, in accordance with the present invention provide a novel combination of strength, toughness, corrosion resistance, and processability. Here and throughout this specification the terms "processability" and "processable" relate to the ability of an alloy or article to be worked thermomechanically without sustaining substantial cracking and/or tearing. The degree of cracking or tearing can be measured with respect to crack volume and crack depth of as hot-worked material. Processability can be assessed based on the ductility and toughness of the alloy material as determined by standard testing procedures.

Here and throughout this specification the following definitions apply. The term "percent" and the symbol "%" designate percent by mass (percent by weight), unless otherwise indicated. The term "boron" or the symbol "B" when used without further qualification means natural boron. The term "powder", "alloy powder", or "metal powder" means an aggregate of discrete alloy or metal particles that are typically in the size range of 1 to 1000 μm.

BRIEF DESCRIPTION OF THE DRAWINGS

The foregoing summary and the following detailed description will be better understood when read with reference to the drawings, wherein.

DETAILED DESCRIPTION OF THE INVENTION

Figure 1:
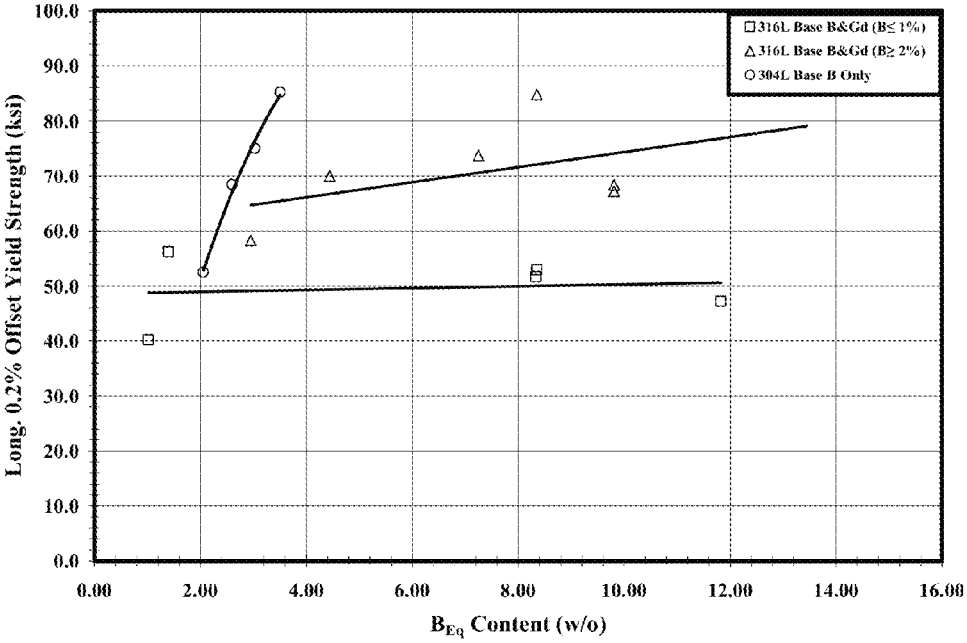
FIG. 1 shows comparative graphs of yield strength as a function of boron equivalent, (% $B_{Eq}$)
Figure 2:
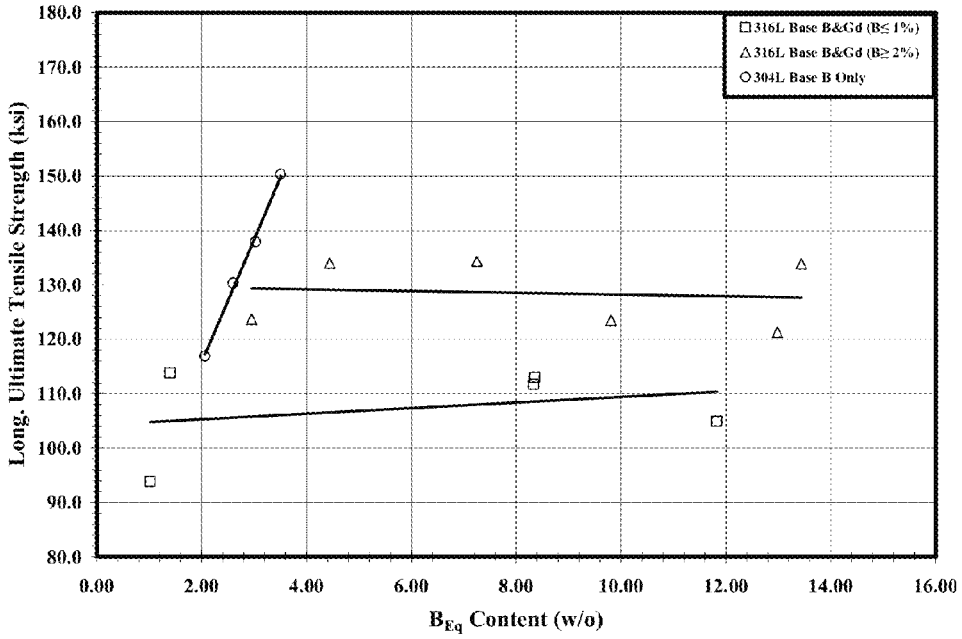
FIG. 2 shows comparative graphs of ultimate tensile strength as a function of % $B_{Eq}$.
Figure 3:
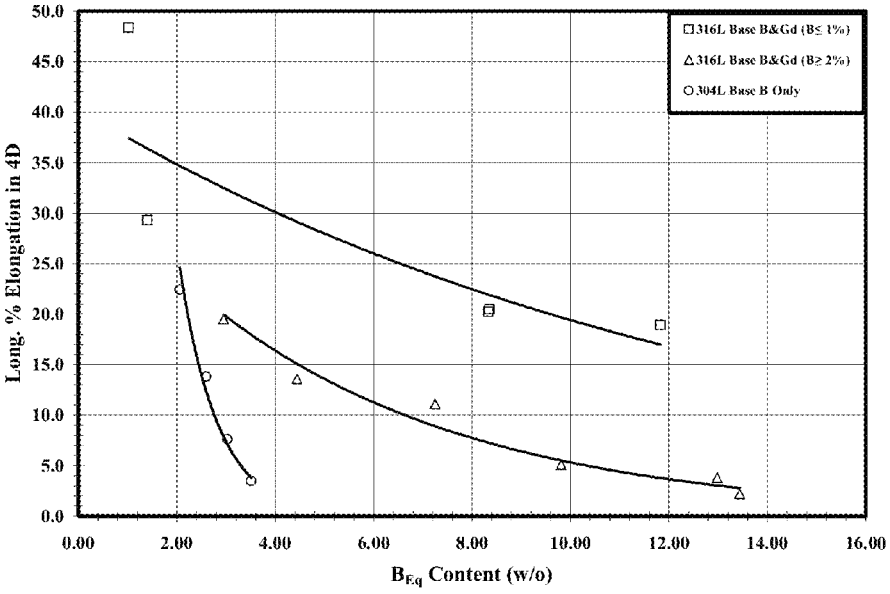
FIG. 3 shows comparative graphs of percent elongation as a function of % $B_{Eq}$.
Figure 4:
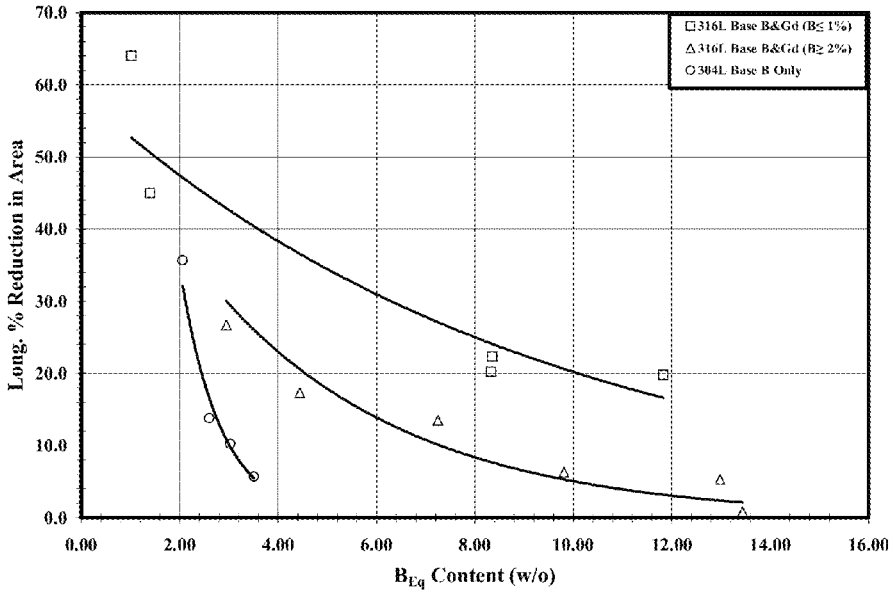
FIG. 4 shows comparative graphs of percent reduction in area as a function of % $B_{Eq}$.
Figure 5:
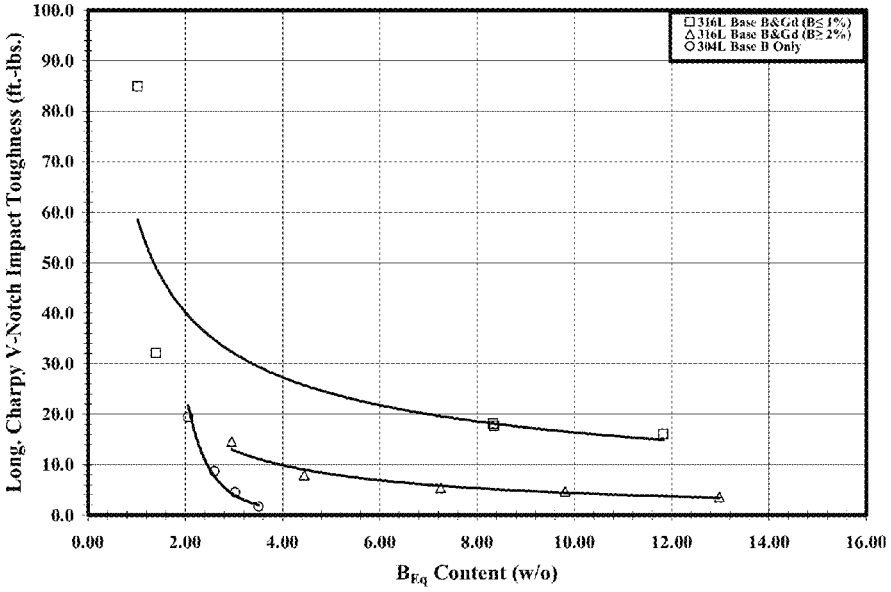
FIG. 5 shows comparative graphs of Charpy V-notch toughness as a function of % $B_{Eq}$.
Figure 6:
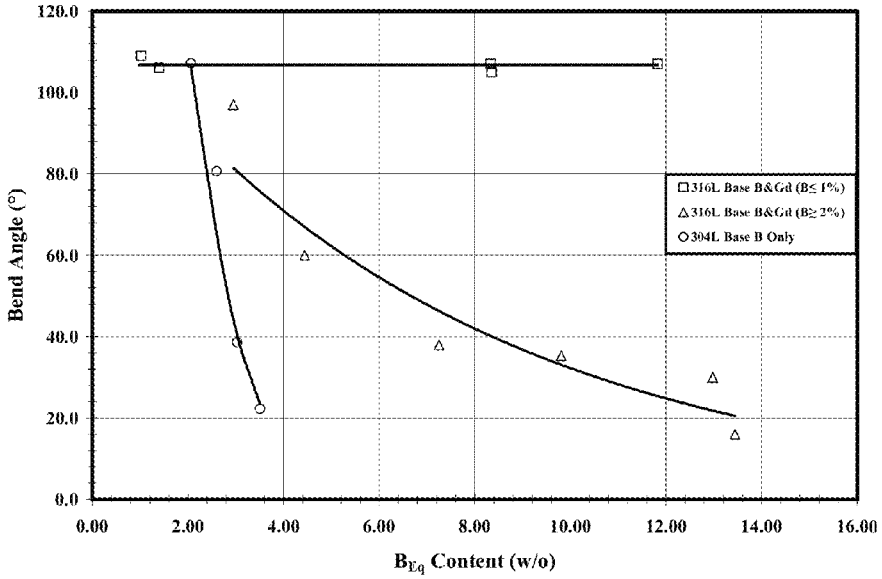
FIG. 6 shows comparative graphs of bend angle as a function of % $B_{Eq}$.
Figure 7:
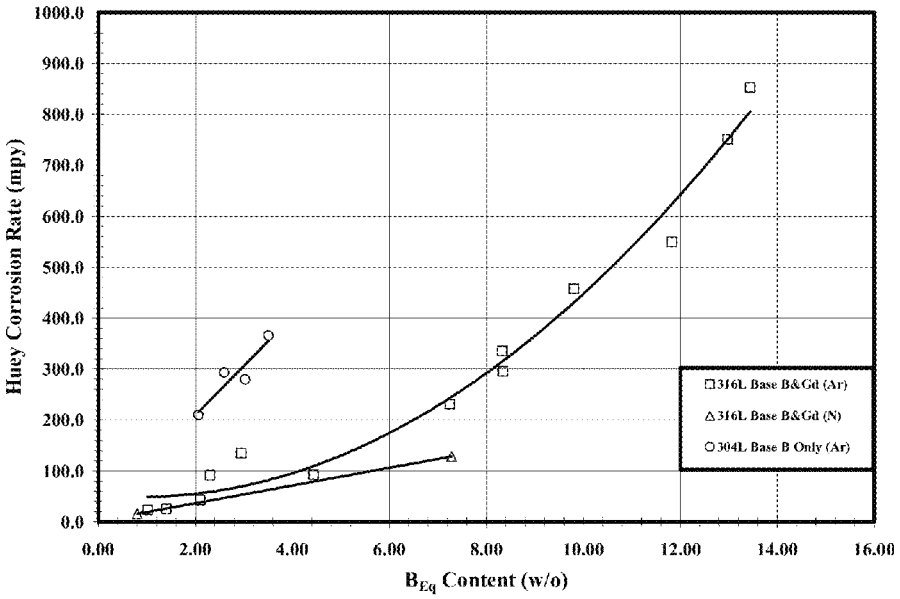
FIG. 7 shows comparative graphs of Huey corrosion rate as a function of % $B_{Eq}$

An alloy and articles made therefrom in accordance with the present invention include the following constituents.

The alloy contains not more than about 0.08% and preferably not more than about 0.05% carbon. In this alloy system carbon, which is an austenite stabilizer, is considered to be a residual element. However, with the chromium content of this material, carbon is restricted to not more than about 0.08% and preferably to not more than about 0.05% to avoid the formation of chromium carbides which could adversely affect the corrosion resistance of the material because of sensitization. Sensitization is the precipitation of chromium carbides in an alloy, particularly at the grain boundaries after exposure to certain elevated temperatures. The alloy grains are thus depleted of chromium in their boundary regions creating areas that are susceptible to corrosive attack.

The alloy according to this invention contains up to about 3% manganese. Manganese like nickel is an austenite stabilizer. This level of manganese permits the use of a reduced amount of nickel than would otherwise be required. Nickel is a more expensive alloying element than manganese. Preferably, the alloy contains at least about 1% manganese. Manganese also increases the solubility of nitrogen in this alloy which beneficially affects the corrosion resistance provided by the alloy.

The alloy also contains up to about 2% silicon. Silicon is typically present in the austenitic stainless steel at a level of about 0.5%. At this level silicon is an effective deoxidizer and thus obviates the need to use aluminum and/or yttrium to deoxidize the molten alloy. Also, because the alloy contains gadolinium as a supplemental neutron absorber, there is some partitioning of silicon to the gadolinide phase.

The alloy also contains about 17-27% chromium. Chromium is a ferrite stabilizer and is necessary in the alloy primarily to benefit the corrosion resistance of the alloy. Chromium also combines with boron to form borides (particularly $M_2B$ borides) which are needed to absorb thermal neutrons. At least about 17% chromium is present to provide corrosion resistance beyond what is currently provided by the known alloys. On the other hand more than about 27% chromium will result in the formation of excessive ferrite (i.e., more than about 10% by volume), particularly in any subsequent welds that might be produced by end users of this product.

The alloy contains at least about 11% nickel, and preferably at least about 12% nickel, in order to avoid the formation of ferrite which adversely affects the corrosion resistance of the alloy. Nickel is an austenite stabilizer and is present to offset the ferrite stabilizing effects of chromium and molybdenum. Because of the presence of manganese, the alloy contains less nickel than would otherwise be needed to provide the same degree of phase stability. In addition to offsetting the ferrite stabilizing effects of chromium and molybdenum, nickel partitions to the gadolinide phase that forms. The partitioning of nickel to the gadolinide phase results in a lower iron content in that phase. The lower iron, higher nickel gadolinide phase benefits the hot-workability of the alloy. Too much nickel increases the cost of the alloy without providing a significant benefit in properties. Therefore, the alloy contains not more than about 20% nickel, and preferably not more than about 16% nickel.

The alloy may contain up to about 5.2% molybdenum. Molybdenum like chromium is a ferrite stabilizer and when present it contributes to the corrosion resistance of the alloy. The benefit to corrosion resistance is obtained when the alloy contains at least about 2.8%, better yet at least about 3.0%, and preferably at least about 3.5% molybdenum. When the additional corrosion resistance provided by the addition of molybdenum is not needed, the alloy may contain a residual amount of molybdenum, preferably, not more than about 0.5% molybdenum.

Molybdenum also partitions to the boride phases that form in articles according to this invention. In the chromium-rich $M_2B$ boride phase, there is approximately 2.0% Mo. However, the $M_3B_2$ boride phase is believed to contain almost 60% Mo. The $M_3B_2$ phase that forms is more highly enriched in boron compared to the chromium-rich $M_2B$ phase, and consequently results in the formation of less of the neutron absorbing second phase. This is important because as the area fraction of the neutron absorbing second phase increases, mechanical properties are adversely affected. Thus, by controlling the amount of these second phase particles, properties can be modified. In particular, tensile and yield strength increases with higher amounts of the second phase boride particles. However, ductility, toughness, NTS/UTS ratio (notch tensile strength to ultimate tensile strength ratio), and bend radius decrease with increasing amounts of the second phase boride particles.

Tungsten is an element that behaves in a manner similar to molybdenum in this alloy. However, because of the differences in atomic weight between molybdenum and tungsten, it takes nearly twice as much tungsten on a weight percent basis to obtain the same effect as a given amount of molybdenum. It is envisioned that tungsten can substitute for all or part of the molybdenum in this alloy system. To ensure the appropriate levels of molybdenum and tungsten are present, a molybdenum equivalency factor, $Mo_{Eq}$, has been derived. The factor $Mo_{Eq}$ is defined as % Mo+% W/1.92. It is used to determine the proper level of tungsten substitution for molybdenum to obtain an equivalent amount of molybdenum plus tungsten relative to 3.0-5.1% molybdenum.

The alloy may contain up to 0.2% nitrogen and preferably contains up to about 0.1% nitrogen. Nitrogen is a strong austenite stabilizer. Although nitrogen reduces the toughness and ductility properties of borated stainless steel, the inclusion of nitrogen in the alloy allows for the use of nitrogen gas atomization of the metal powder to reduce the cost of producing the alloy powder relative to argon gas atomization. The use of nitrogen gas for atomization enhances the corrosion resistance. Nitrogen gas atomization also enhances the weldability of the alloy because an article made from nitrogen atomized alloy powder does not develop micro-porosity in the weld zone as does an article made from argon-atomized material. Therefore, when atomized with nitrogen gas the alloy powder contains more than 300 ppm nitrogen, for example, at least about 0.05%.

The alloy powder of this invention preferably contains at least about 0.25% boron. Boron benefits the thermal neutron absorption capability of the product. This is accomplished through the formation of the second phase boride particles such as $M_2B$ and $M_3B_2$. Since those particles contain chromium and molybdenum, it is important to maintain the required matrix level of those elements to ensure that the corrosion resistance and phase stability are not adversely affected. At least about 0.25% boron is needed to effectively co-nucleate with the gadolinide phase that forms in the material, such co-nucleation benefits the processability of the alloy. Too much boron adversely affects the toughness, ductility, and processability of the alloy. Therefore, boron is restricted to not more than about 2.5%, better yet to not more than about 2.0%, and preferably to not more than about 1.0% in this material. Good strength and acceptable toughness and ductility are obtained when the alloy contains more than 2% boron. A good combination of strength, toughness, and ductility are obtained when the alloy contains 2% boron or less. The best toughness and ductility are obtained when the alloy contains not more than about 1% boron.

The alloy further contains at least about 0.05% and preferably at least about 0.12% gadolinium. Gadolinium is a neutron absorber like boron. However, unlike boron, gadolinium forms a gadolinide phase that is rich in nickel and iron. Because the gadolinide phase ties up nickel, it is important to balance out this partitioning effect to ensure proper phase stability. Gadolinium is 4.35 times more potent as a thermal neutron absorber compared to naturally occurring boron. Therefore, gadolinium can be used to cost effectively reduce the overall amount of thermal neutron absorbing second phase boride particles to create improved property performance. Consequently, the volume fraction of the second phase boride particles in this alloy can be reduced relative to the known alloy while the material provides neutron absorption capability that is at least as good as that provided by the known boron-only alloy. Nevertheless, it is important that boron be present in conjunction with gadolinium because some of the boron in the alloy partitions to the gadolinide phase and the gadolinide phase co-nucleates with the boride phases during solidification. This is significant because straight gadolinium-bearing alloys have limited hot-workability because of the formation of a low melting phase. The combination of gadolinium, boron, and nickel as set forth above, together with powder metallurgy processing, benefits the hot workability of the material compared to the known gadolinium-bearing materials. Too much gadolinium adversely affects the hot workability and processability of the alloy. The alloy powder of this invention may contain up to about 2.6% gadolinium.

The beneficial contribution of both boron and gadolinium relative to neutron absorption capability can be quantified by reference to a boron equivalency factor, $B_{Eq}$. The factor $B_{Eq}$ is a means to express the boron level that is equivalent to the combination of boron and gadolinium, in terms of neutron absorption. According to this invention, $B_{Eq}$ is described as % B+(4.35×% Gd) because Gd is 4.35 times more potent as a thermal neutron absorber compared to natural boron. The balance of the alloy composition is iron and the usual impurities found in commercial grades of iron-base neutron absorbing alloys. Phosphorus is an impurity and is preferably restricted to a residual level of about 0.05% max. in order to avoid an adverse effect on the workability of the alloy resulting from hot shortness. Sulfur, like phosphorus, is an impurity and is preferably restricted to a residual level of about 0.03% max. in order to avoid an adverse effect on the workability of the alloy resulting from hot shortness. Deoxidizing additions such as aluminum and yttrium are not intentionally present in this alloy, but may be present as inevitable impurities. Accordingly, the alloy powder contains less than 0.01% aluminum and less than 0.005% yttrium. Oxygen is inevitably present in this alloy, and the alloy may contain up to about 0.1% oxygen depending on how fine the powder is. It is expected that the alloy powder will contain at least about 100 ppm oxygen unless special techniques are employed.

Although a broad range of alloy compositions is described above, it is contemplated that preferred ranges of alloys will be realized depending on the property requirements for particular applications of the articles according to this invention. For example, subranges of the various element ranges described above can be selected to optimize particular properties such as corrosion resistance, neutron absorption, strength, toughness, and combinations thereof, to mention a few.

An article in accordance with the present invention is preferably formed by a powder metallurgy process. The preferred powder metallurgy process is as follows. The alloy is first melted under an oxygen-free atmosphere, e.g., vacuum induction melting (VIM), and atomized by means of an inert atomizing fluid such as argon gas or nitrogen gas. The particle size of the prealloyed powder is not critical, but it is desirable to remove excessively large particles. Sifting the prealloyed powder through a 40 mesh screen for that purpose gives good results. Segregation of the powder by particle size can be advantageously minimized by blending the powder. Thus, before the powder material is placed in a container, it is preferably blended to obtain a uniform particle size distribution.

The alloy powder is filled into one or more metal canisters prior to consolidation. When the canister is made from an austenitic stainless steel, such as AISI type 304 or 316 stainless steel, the alloy powder and the canister are preferably baked to remove moisture prior to the powder being loaded into the canister. The baking temperature in air is preferably less than 400° F. to avoid oxidation. A baking temperature of 250° F. has provided good results. The dried powder is loaded into the canister which must be clean and essentially free of oxides. A canister made of a low carbon, mild steel can also be used. In such event, it is not necessary to bake the alloy powder or the canister prior to filling the canister.

When the canister is filled with the powder it is closed and then preferably evacuated to remove air and any absorbed moisture. To this end the canister is preferably evacuated to less than 100 microns Hg. The canister can be heated during the evacuation process to facilitate the removal of moisture. When the air and water vapor levels inside the canister are satisfactory, evacuation is stopped and the canister is sealed and then compacted.

Hot isostatic pressing (HIP'ng) is the preferred method for compacting the metal powder. As is well known, the temperature, pressure, and the duration for which the material is held at the selected temperature and pressure depend on the alloy powder and the canister size and shape, all of which are readily determined. The temperature to be used must be below the incipient melting temperature of the alloy. The HIP'ng temperature is kept low, preferably about 2000°-2100° F. to limit growth of the boride/gadolinide particles. The HIP cycle is preferably conducted at a pressure of about 15 ksi for a time sufficient to obtain a substantially fully dense compact. The time required at temperature and pressure depends on the section size of the canister, i.e., more time is needed for larger canister section thickness.

Although preparation of an alloy compact used in the present invention has been described with reference to a conventional powder metallurgy technique, it is contemplated that it can be prepared by other methods. For example, the simultaneous consolidation and reduction of metal powder disclosed in U.S. Pat. No. 4,693,863 could be utilized. Rapid solidification casting techniques are also applicable to the present invention. It is important that the method of preparation selected provide rapid cooling of the alloy from the molten state and that any intermediate consolidation steps be limited with respect to temperature, in order to limit the growth of the boride particles.

The compacted alloy powder can be hot and/or cold worked to the desired article form. More particularly, the alloy is mechanically hot worked from a starting temperature in the range of 2050°-2125° F., by pressing, hammering, rotary forging, or flat rolling. A preferred method of hot working the material includes hot forging the alloy powder compact from a starting temperature of about 2050°-2125° F. followed by hot rolling from a starting temperature of about 2050°-2125° F. to provide a flat form such as strip or plate. The flat form can be cold rolled or ground to finish size as required. The final form of the article is preferably annealed at about 1900°-1950° F. for 30 minutes and rapidly quenched to room temperature preferably in water.

WORKING EXAMPLES

Twenty-six (26) nominal 140-300 lb heats were vacuum induction melted and atomized. Twenty-four of the heats were atomized with argon gas and the other two heats (878 and 879) were atomized with nitrogen gas. The weight percent compositions of the heats are set forth in Tables IA and IB below. Table IA shows the compositions of the alloy according to the present invention and Table IB shows the compositions of comparative alloys. The balance of each heat was iron and usual impurities.

The atomized alloy powder from each heat was screened to −40 mesh (420 micron and finer) and blended. A portion of the blended powder of Heat 105 was further screened to −140 mesh and −270 mesh to provided three separate batches, hereinafter designated Heats 105-1, 105-2, and 105-3, respectively). The alloy powder from each heat and from the three batches of Heat 105 was vibration filled into two (2) 1¾ inches×6 inches×26 inches canisters formed from 0.125 inch thick, low carbon steel. The canisters were degassed at 250° F., evacuated to a pressure of less than 20 microns Hg, welded shut, and then hot isostatically pressed (HIP'd) at 15 ksi and 2050° F. for 4 to 6 hours at temperature and pressure to substantially full density. One HIP'd canister per heat was hot-rolled to ¾-inch thick plate. In order to facilitate handling each canister was sectioned prior to hot rolling. All material was hot-rolled from a starting temperature of 2050° F. using ⅛-inch reductions per pass and 2 passes per heating cycle. The intermediate material was reheated at 2050° F. for 20-30 minutes after each rolling pass. Upon completion of the final roll pass, the ¾-inch plate sections were straightened and then annealed for 1 hour at 1950° F. followed by water quenching to room temperature. The heats containing boron and gadolinium according to the present invention were successfully hot rolled as evidenced by an absence of tears or cracks in the as-processed plate. Accordingly, it was verified that the alloys according to the present invention demonstrated processability despite the presence of boron and gadolinium in the alloy material. Heat 876 having a $B_{Eq}$ higher than the alloy of the present invention and a boron content very near the upper limit of this alloy was not processable as evidenced by significant hot tearing during the hot-rolling step.

TABLE IA

| Element | Composition (%) | | | | | | | | | | | | | | |
|---|---|---|---|---|---|---|---|---|---|---|---|---|---|---|---|
| | 715 | 716 | 757 | 758 | 760 | 761 | 762 | 873 | 874 | 875 | 877 | 878 | 879 | 880 | 105[1] |
| C | 0.021 | 0.044 | 0.032 | 0.036 | 0.024 | 0.039 | 0.040 | 0.022 | 0.040 | 0.038 | 0.015 | 0.005 | 0.015 | 0.008 | 0.022 |
| Mn | 1.99 | 1.76 | 2.26 | 2.12 | 2.12 | 2.38 | 2.39 | 2.22 | 2.55 | 2.53 | 2.13 | 2.03 | 2.22 | 2.00 | 2.12 |
| Si | 0.53 | 0.46 | 0.38 | 0.44 | 0.44 | 0.38 | 0.36 | 0.50 | 0.44 | 0.43 | 0.59 | 0.55 | 0.49 | 0.56 | 0.52 |
| P | 0.010 | 0.006 | 0.004 | 0.005 | 0.004 | 0.006 | 0.004 | <0.005 | 0.008 | 0.009 | <0.005 | <0.005 | <0.005 | <0.005 | 0.003 |
| S | 0.002 | 0.002 | <0.001 | <0.001 | 0.001 | 0.001 | 0.001 | 0.002 | 0.004 | 0.002 | 0.003 | <0.001 | 0.005 | 0.001 | 0.002 |
| Cr | 22.12 | 24.38 | 22.70 | 21.20 | 21.18 | 24.39 | 24.10 | 20.07 | 23.51 | 23.51 | 18.30 | 17.82 | 20.00 | 17.95 | 20.07 |
| Ni | 13.50 | 13.68 | 12.92 | 13.64 | 13.64 | 12.29 | 12.65 | 12.91 | 11.62 | 11.92 | 14.03 | 13.17 | 12.83 | 13.19 | 13.18 |
| Mo | 4.04 | 0.01 | 4.54 | 3.98 | 3.98 | 5.24 | 5.19 | 3.85 | 5.11 | 5.17 | 3.26 | 2.87 | 3.86 | 2.87 | 3.70 |
| Cu | <0.01 | <0.01 | <0.01 | <0.01 | <0.01 | <0.01 | <0.01 | <0.01 | <0.01 | <0.01 | <0.01 | <0.01 | <0.01 | <0.01 | <0.01 |
| Co | 0.01 | 0.01 | <0.01 | <0.01 | <0.01 | <0.01 | <0.01 | <0.01 | <0.01 | <0.01 | <0.01 | <0.01 | <0.01 | <0.01 | <0.01 |
| Ti | N.A. | N.A. | N.A. | N.A. | N.A. | N.A. | N.A. | <0.01 | <0.01 | <0.01 | <0.01 | <0.01 | <0.01 | <0.01 | <0.01 |
| N | 0.0014 | 0.0018 | 0.0014 | 0.0017 | 0.0013 | 0.0017 | 0.0012 | 0.002 | 0.002 | 0.002 | 0.002 | 0.162 | 0.075 | 0.002 | 0.002 |
| B | 1.14 | 3.04 | 1.52 | 1.82 | 1.14 | 2.01 | 2.03 | 1.04 | 1.98 | 2.02 | 0.69 | 0.23 | 0.97 | 0.28 | 1.02 |
| O | 0.0212 | 0.0199 | 0.0232 | 0.0232 | 0.0204 | 0.0201 | 0.0177 | 0.015 | 0.013 | 0.024 | 0.016 | 0.016 | 0.038 | 0.012 | 0.024 |
| Gd | 0.06 | 0.14 | 0.18 | 0.26 | 0.22 | 0.56 | 1.20 | 1.68 | 1.80 | 2.52 | 2.56 | 0.13 | 1.45 | 0.17 | 1.68 |
| Al | 0.002 | 0.004 | 0.002 | 0.003 | 0.006 | 0.005 | 0.006 | N.A. | N.A. | N.A. | N.A. | N.A. | N.A. | N.A. | N.A. |
| Y | <0.001 | <0.001 | <0.001 | <0.001 | <0.001 | <0.001 | <0.001 | N.A. | N.A. | N.A. | N.A. | N.A. | N.A. | N.A. | N.A. |
| $B_{Eq}$ | 1.40 | 3.65 | 2.30 | 2.95 | 2.1 | 4.45 | 7.25 | 8.35 | 9.81 | 12.98 | 11.83 | 0.80 | 7.28 | 1.02 | 8.33 |

N.A.: element not analyzed

[1] Heat 105 is blend of the powders from two argon atomized heats (871 and 872), the wt. % compositions of which are set forth below.

| | C | Mn | Si | P | S | Cr | Ni | Mo | Cu | Co | Ti | N | B | O | Gd | Al | Y | $B_{Eq}$ |
|---|---|---|---|---|---|---|---|---|---|---|---|---|---|---|---|---|---|---|
| Ht. 871 | 0.017 | 2.14 | 0.49 | <0.005 | 0.002 | 20.08 | 13.25 | 3.85 | <0.01 | <0.01 | <0.01 | 0.003 | 1.00 | 0.022 | 1.57 | N.A. | N.A. | 7.83 |
| Ht. 872 | 0.018 | 2.22 | 0.49 | <0.005 | 0.002 | 20.02 | 13.05 | 3.72 | <0.01 | <0.01 | <0.01 | 0.002 | 1.04 | 0.010 | 1.66 | N.A. | N.A. | 8.26 |

TABLE IB

| Element | Composition (%) | | | | | | | | | |
|---|---|---|---|---|---|---|---|---|---|---|
| | 708 | 709 | 710 | 711 | 712 | 713 | 754 | 755 | 756 | 876 |
| C | 0.037 | 0.040 | 0.040 | 0.046 | 0.025 | 0.041 | 0.021 | 0.038 | 0.036 | 0.042 |
| Mn | 1.68 | 1.71 | 1.73 | 1.75 | 1.71 | 1.76 | 2.09 | 2.44 | 2.43 | 2.66 |
| Si | 0.54 | 0.52 | 0.48 | 0.48 | 0.52 | 0.48 | 0.48 | 0.39 | 0.40 | 0.41 |
| P | <0.005 | 0.005 | 0.006 | 0.006 | 0.011 | 0.011 | 0.003 | 0.005 | 0.005 | 0.011 |
| S | 0.001 | 0.001 | 0.001 | 0.002 | 0.002 | 0.001 | 0.001 | 0.001 | 0.002 | 0.001 |
| Cr | 19.48 | 22.05 | 24.36 | 26.27 | 24.01 | 24.12 | 21.28 | 24.71 | 24.67 | 25.33 |
| Ni | 13.52 | 13.58 | 13.66 | 13.68 | 13.44 | 13.53 | 13.48 | 11.93 | 12.00 | 11.32 |
| Mo | <0.01 | <0.01 | <0.01 | <0.01 | 4.42 | 3.89 | 4.00 | 5.28 | 5.34 | 5.74 |
| Cu | <0.01 | <0.01 | 0.01 | 0.01 | <0.01 | 0.01 | <0.01 | <0.01 | <0.01 | <0.01 |
| Co | 0.01 | 0.01 | 0.01 | 0.01 | 0.01 | 0.02 | <0.01 | <0.01 | <0.01 | <0.01 |
| Ti | N.A. | N.A. | N.A. | N.A. | N.A. | N.A. | N.A. | N.A. | N.A. | <0.01 |
| N | <0.0010 | <0.0010 | <0.0010 | <0.0010 | 0.0011 | 0.0013 | <0.0010 | 0.0012 | 0.0012 | 0.002 |
| B | 2.06 | 2.60 | 3.03 | 3.51 | 1.50 | 2.98 | 1.12 | 1.97 | 1.97 | 2.48 |
| O | 0.0186 | 0.0193 | 0.0174 | 0.0227 | 0.0192 | 0.0209 | 0.0206 | 0.0178 | 0.0181 | 0.014 |
| Gd | — | — | — | — | — | — | <0.01 | <0.01 | <0.01 | 2.52 |
| Al | 0.002 | 0.002 | 0.002 | 0.003 | 0.001 | 0.002 | 0.001 | 0.001 | 0.001 | N.A. |
| Y | <0.001 | <0.001 | <0.001 | <0.001 | <0.001 | <0.001 | <0.001 | <0.001 | <0.001 | N.A. |
| $B_{Eq}$ | 2.06 | 2.60 | 3.03 | 3.51 | 1.50 | 2.98 | 1.12 | 1.97 | 1.97 | 13.44 |

N.A.: element not analyzed.

Standard size, longitudinal specimens for tensile, Charpy V-notch, bend angle, Huey corrosion testing were prepared from the ¾-inch thick plates of each heat. The results of room temperature mechanical testing including the 0.2% offset yield strength (0.2% YS) and the ultimate tensile strength (UTS) in ksi, the percent elongation (% El.) and the percent reduction in area (% R.A.) are presented in Table HA below for the heats representing the alloy of this invention (Table IA). The results for the comparative heats (Table IB) are presented in Table IIB. Also shown in Tables IIA and IIB are the results of room temperature Charpy V-notch impact testing (CVN) in foot-pounds (ft.-lbs.), the ratio of the notch tensile strength ($K_t$=8.0) to ultimate tensile strength (NTS/UTS), the results of bend testing (Bend Angle) in degrees, and the results of Huey corrosion testing (Con. Rate) in mils per year (mpy).

The bend test is performed as follows. The test specimen, which is a standard Strauss corrosion test coupon (as per ASTM A262, Practice A), is bent through a 1 9/16 inch wide slot using a ⅜ inch diameter mandrel and 1200 psi hydraulic ram. The Huey corrosion testing was performed in accordance with ASTM A262, Practice C.

TABLE IIA

| Heat | 0.2% YS | UTS | % El. | % R.A. | CVN | NTS/UTS | Bend Angle | Corr. Rate |
|---|---|---|---|---|---|---|---|---|
| 715 | 56.2 | 113.8 | 29.3 | 45.0 | 32.1 | 1.13 | 106.1 | 25.00 |
| 716 | 80.5 | 142.9 | 17.8 | 9.7 | 3.9 | 0.81 | 43.0 | 206.50 |
| 757 | 59.9 | 122.0 | 23.0 | 32.0 | 18.7 | 1.05 | 104.0 | 91.50 |
| 758 | 58.3 | 123.7 | 19.5 | 26.7 | 14.6 | 1.04 | 97.0 | 134.40 |
| 760 | 56.3 | 113.2 | 29.2 | 42.1 | 28.1 | 1.11 | 106.0 | 42.80 |
| 761 | 70.0 | 134.0 | 13.6 | 17.3 | 7.9 | 1.00 | 60.0 | 92.60 |

TABLE IIA-continued

| Heat | 0.2% YS | UTS | % El. | % R.A. | CVN | NTS/UTS | Bend Angle | Corr. Rate |
|---|---|---|---|---|---|---|---|---|
| 762 | 73.7 | 134.3 | 11.1 | 13.5 | 5.4 | 0.89 | 38.0 | 230.90 |
| 873 | 52.9 | 113.0 | 20.5 | 22.3 | 17.7 | 1.06 | 105.0 | 295.1 |
| 874 | 68.3 | 123.5 | 5.1 | 6.3 | 4.7 | 0.95 | 35.3 | 457.4 |
| 875 | 67.2 | 121.3 | 3.8 | 5.3 | 3.6 | 0.84 | 30.0 | 750.5 |
| 877 | 47.2 | 104.9 | 18.9 | 19.8 | 16.1 | 1.00 | 107.0 | 549.7 |
| 878 | 45.6 | 100.5 | 46.2 | 62.5 | 69.7 | 1.21 | 108.0 | 15.6 |
| 879 | 54.2 | 113.1 | 21.7 | 28.3 | 23.0 | 1.11 | 106.3 | 129.8 |
| 880 | 40.2 | 93.9 | 48.4 | 64.0 | 84.9 | 1.20 | 109.0 | 23.0 |
| 105-1 | 51.7 | 111.7 | 20.2 | 20.2 | 18.1 | 1.00 | 107.0 | 335.4 |
| 105-2 | 53.8 | 112.5 | 19.0 | 19.7 | 18.2 | 1.02 | 107.0 | 185.8 |
| 105-3 | 52.6 | 112.2 | 21.6 | 22.4 | 17.7 | 1.02 | 106.7 | 231.4 |

TABLE IIB

| Heat | 0.2% YS | UTS | % El. | % R.A. | CVN | NTS/UTS | Bend Angle | Corr. Rate |
|---|---|---|---|---|---|---|---|---|
| 708 | 85.2 | 116.9 | 22.4 | 35.7 | 19.4 | 1.03 | 107.2 | 209.35 |
| 709 | 68.4 | 130.3 | 13.8 | 13.8 | 8.7 | 0.95 | 80.6 | 293.50 |
| 710 | 75.0 | 137.9 | 7.6 | 10.2 | 4.5 | 0.85 | 38.6 | 279.50 |
| 711 | 85.2 | 150.3 | 3.5 | 5.7 | 1.7 | 0.59 | 22.3 | 365.55 |
| 712 | 59.6 | 121.4 | 24.7 | 36.2 | 23.2 | 1.09 | 105.2 | 32.25 |
| 713 | 83.5 | 144.4 | 5.2 | 8.0 | 2.8 | 0.75 | 31.4 | 231.00 |
| 754 | 48.6 | 111.5 | 31.7 | 46.4 | 33.5 | 1.07 | 108.0 | 57.30 |
| 755 | 68.0 | 132.3 | 17.1 | 20.7 | 10.7 | 1.01 | 63.0 | 111.10 |
| 756 | 67.2 | 131.8 | 15.6 | 19.2 | 10.1 | 0.96 | 73.0 | 105.00 |
| 876 | 84.8 | 133.9 | 2.2 | 0.8 | Note | 0.63 | 16.0 | 852.8 |

Note: Not tested because usable test specimens could not be obtained.

The values presented are the averages of the measured values. For Heats 708 to 716 the mechanical, CVN, and NTS/UTS results are the averages for five (5) tested specimens of each heat. For Heats 754 to 762, 873 to 880, 105-1, 105-2, and 105-3, the mechanical, CVN, and NTS/UTS results are the averages for three (3) tested specimens of each heat. For Heats 708 to 716 and 754 to 762, the bend testing and Huey corrosion testing results are the averages for two (2) specimens of each heat. For the other heats, the bend testing and Huey corrosion testing results are the averages for three (3) specimens of each heat.

Graphical analyses of the test results shown in Tables IIA and IIB as a function of $B_{Eq}$ are presented in FIGS. 1-7. There is generally good agreement between the variable being plotted and the $B_{Eq}$ content. Both the 0.2% YS and UTS plots (FIGS. 1 and 2) show that the trend line of the heats having B≥2% lies above that of the trend line for the heats with a B≤1% at a comparable $B_{Eq}$. Plots of tensile ductility, CVN impact toughness, and bend angle as a function of $B_{Eq}$ content (FIGS. 3-6) clearly show the superior ductility, toughness, and fabricability provided by the heats with boron content≤1% at a comparable $B_{Eq}$ content when compared to the heats with a boron content≥2% and the straight B-bearing 304 L heats. The graphs in FIG. 7 for Huey corrosion rate show the superior corrosion resistance provided by the 316 L-based (Mo-containing) heats containing boron and gadolinium when compared to the 304 L-base heats (<0.5% Mo) containing boron, but no positive addition of gadolinium.

Figure 8:
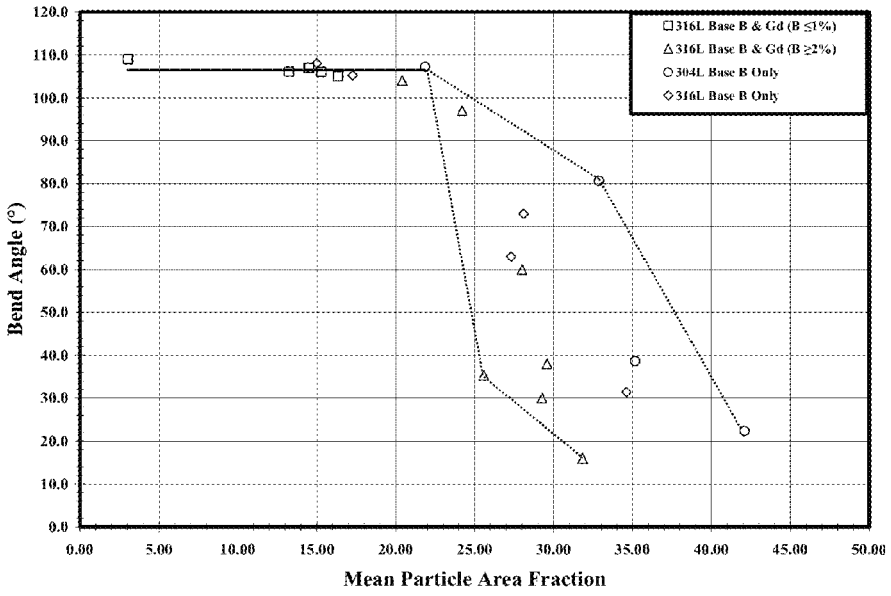
FIG. 8 shows comparative graphs of bend angle as a function of the mean area fraction of boride and gadolinide particles.

The bend angle test results were analyzed as a function of mean area fraction of the boride and gadolinide particles. A graphical analysis is shown in FIG. 8 which clearly indicates a rapid drop-off in the bend angle achieved when the mean particle area fraction is greater than about 22%.

Comparison of Powder Metallurgy Product to Cast-Wrought Product

In order to demonstrate the significant improvement in processability provided by the powder metallurgy product according to this invention, a series of powder metallurgy heats was prepared for comparison with a series of cast and wrought heats of known alloys that contains B and Gd. The weight percent compositions of the test heats are set forth in Table III below.

TABLE III

| Element | Heat 046 | Heat 881 | Heat 047 | Heat 866 | Heat 048 | Heat 869 | Heat 049 | Heat 870 | Heat 050 | Heat 868 |
|---|---|---|---|---|---|---|---|---|---|---|
| C | 0.007 | 0.008 | 0.009 | 0.006 | 0.012 | 0.015 | 0.013 | 0.21 | 0.008 | 0.011 |
| Mn | 0.31 | 0.39 | 0.83 | 0.89 | 1.14 | 1.18 | 1.20 | 1.22 | 1.14 | 1.16 |
| Si | 0.20 | 0.20 | 0.23 | 0.24 | 0.34 | 0.27 | 0.38 | 0.40 | 0.33 | 0.34 |
| P | <0.005 | <0.005 | <0.005 | 0.006 | <0.005 | <0.005 | <0.005 | <0.005 | 0.005 | <0.005 |
| S | <0.001 | 0.001 | <0.001 | <0.001 | <0.001 | <0.001 | <0.001 | 0.001 | <0.001 | <0.001 |
| Cr | 22.12 | 22.12 | 18.12 | 18.16 | 20.22 | 20.44 | 20.66 | 20.76 | 20.34 | 20.52 |
| Ni | 18.56 | 18.25 | 10.35 | 10.16 | 11.62 | 11.73 | 11.64 | 11.64 | 15.14 | 15.16 |
| Mo | 2.78 | 2.88 | 4.13 | 4.22 | 0.06 | 0.11 | <0.01 | <0.01 | 4.05 | 4.13 |
| Cu | <0.01 | <0.01 | <0.10 | <0.01 | <0.01 | <0.01 | <0.01 | <0.01 | <0.01 | <0.01 |
| Co | <0.01 | <0.01 | <0.01 | <0.01 | <0.01 | <0.01 | <0.01 | 0.01 | <0.01 | <0.01 |
| Ti | 0.01 | <0.01 | <0.01 | <0.01 | <0.01 | <0.01 | <0.01 | <0.01 | <0.01 | <0.01 |
| O | 0.003 | 0.010 | 0.002 | 0.015 | 0.001 | 0.022 | <0.001 | 0.014 | <0.001 | 0.014 |
| Gd | 0.42 | 0.44 | 0.32 | 0.27 | 0.79 | 0.66 | 0.46 | 0.54 | 0.33 | 0.26 |
| N | 0.001 | 0.001 | 0.002 | 0.002 | 0.002 | 0.002 | 0.002 | 0.002 | 0.003 | 0.003 |
| B | 0.39 | 0.40 | 0.12 | 0.26 | 0.62 | 0.62 | 1.10 | 1.14 | 0.54 | 0.58 |
| Al | 0.03 | — | 0.03 | — | 0.10 | — | 0.09 | — | 0.12 | — |
| Y | 0.028 | — | — | — | — | — | — | — | — | — |
| Mg | — | — | — | — | 0.032 | — | 0.032 | — | 0.034 | — |
| $B_{Eq}$ | 2.22 | 2.31 | 1.51 | 1.43 | 4.06 | 3.49 | 3.10 | 3.49 | 1.98 | 1.71 |

Note:
The balance of each heat was iron and usual impurities.

The weight percent compositions of Heats 046 and 047 are similar to Examples 8 and 20, respectively, described in U.S. Pat. No. 5,820,818. The weight percent compositions of Heats 881 and 866 were selected to be similar to Heats 046 and 047, respectively. The weight percent compositions of Heats 048, 049, and 050 are similar to Examples 3, 5, and 16, respectively, described in published Japanese patent application JP 06-1902792. The weight percent compositions of Heats 869, 870, and 868 were selected to be similar to Heats 048, 049, and 050, respectively.

Heats 046, 047, 048, 049, and 050 were vacuum induction melted, cast as 35 lb. ingots, and allowed to solidify. During melting, these heats were deoxidized with aluminum and yttrium in accordance with the descriptions in the respective patent documents. Heats 881, 866, 869, 870, and 868 were vacuum induction melted, nominal 170 pound heats. Each of these heats was atomized with argon gas to form metal powder. The metal powder of each heat was blended and screened to −40 mesh and then filled into two (2) 4½ inch square by 9 inch long canisters formed from 0.125 inch thick, low carbon steel. The filled canisters were sealed, degassed, and then hot isostatically pressed (HIP) at 2050° F. and 15 ksi for 4-6 hours at temperature and pressure to substantially full density.

The cast VIM ingots and one of each of the HIP'd canisters were heated to forging temperature and then press forged to billets having a cross-section of 1⅝ inches high by 5 inches wide. The ingots of Heats 046 and 047 and the canisters of Heats 881 and 866 were pressed forged from a starting temperature of 1922° F. The ingots of Heats 048, 049, and 050 and the canisters of Heats 869, 870, and 868 were pressed forged from a starting temperature of 1832° F. The forging temperatures were selected based on the processing described in the US patent and in the Japanese patent application. All heats were press forged using ½-inch increments per pass and ½-hour reheats between passes. The cast VIM heats were single end forged and the powder metallurgy heats were double-end forged.

The press forged billets were then hot rolled to ¾-inch thick plate using the same hot-working temperatures described above for the press forging. The hot rolling was conducted with ⅛-inch increments per pass with a 20-30 minute reheat between passes. Following the conversion to ¾-inch thick plate material, each heat was annealed as follows. Heats 046, 047, 881, and 866 were heated at 1922° F. for 1 hour and then water quenched. Heats 048-050 and 868-870 were heated at 2012° F. for 1 hour and water quenched.

The cast VIM heats, 046, 048, 049, and 050 all experienced significant hot tearing during forging. Following the hot rolling to plate, those same heats experienced additional significant hot tearing. In particular, heat 050 broke-up during the first hot-rolling pass and the hot tearing of heat 049 became so pronounced that it was not possible to obtain blanks for mechanical and corrosion testing. Heat 047 was successfully forged and hot rolled. However, that result is attributable to the presence of ferrite in the microstructure. Consequently, heat 047 is not considered a truly austenitic grade. All of the powder metallurgy heats, 881, 866, 868, 869, and 870 were successfully forged and hot rolled. Heat 866 also had a duplex (austenite+ferrite) microstructure.

Triplicate notched tensile, smooth tensile, and Charpy V-notch test specimens were cut and machined from the plate material of each heat in accordance with the standard requirements for such test specimens. The notched tensile specimens were prepared using a stress concentration factor, $K_t$, of 8.0. All tensile and Charpy samples were tested at room temperature in accordance with standard ASTM requirements.

Blanks for bend testing were sectioned along the long axis of the plate material to yield three ¼ inch×¾ inch×3¼ inch blanks that were subsequently fabricated into standard Strauss coupons as described above. Triplicate bend tests were performed using a ⅜-inch mandrel that bent the sample through a 1 9/16-inch slot with a 1,200 psi hydraulic ram. Upon completion of the testing the bend angle was measured.

Six (6) Huey corrosion blanks each measuring 3/16 inch×¾ inch×1⅝ inches were prepared. The blanks were subsequently fabricated into standard Huey corrosion coupons. Triplicate tests were run in boiling 65% nitric acid for five 48 hour time periods per the requirements of ASTM A262-C (Huey test). One untested coupon was tested for immersion density per ASTM B311 at room temperature in order to facilitate corrosion rate calculations.

The results of the longitudinal and transverse, room temperature, tensile testing are reported in Tables IV-VII including the 0.2% offset yield strength (0.2% YS), the ultimate tensile strength (UTS), and the notched tensile strength (NTS) all in ksi, the NTS/UTS ratio, the percent elongation in four diameters (% El.), and the percent reduction in area (% R.A.). The results of room temperature Charpy V-notch (CVN) testing in ft-lbs are shown in Table VII.

Figure 9:
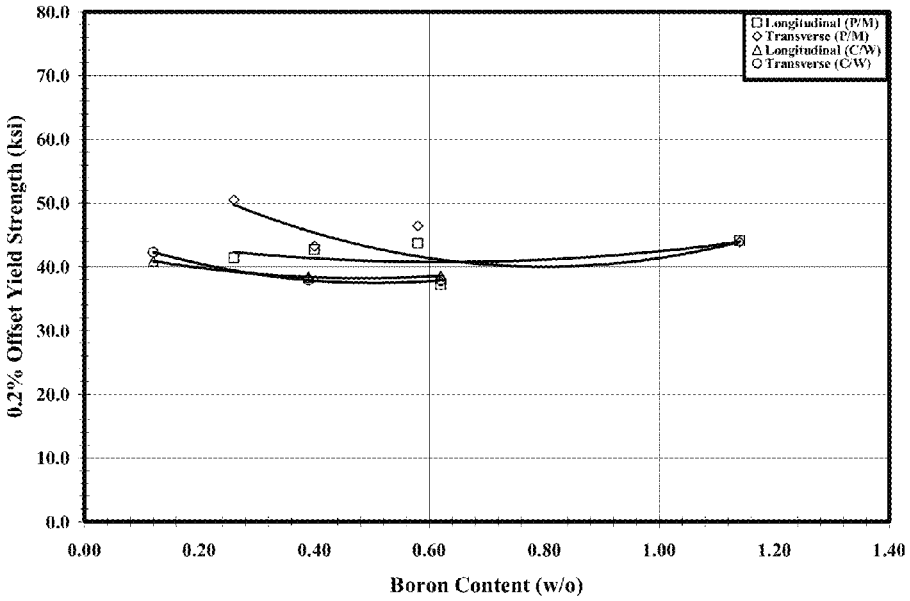
FIG. 9 shows comparative graphs of yield strength as a function of boron content in wt. % (% B)
Figure 10:
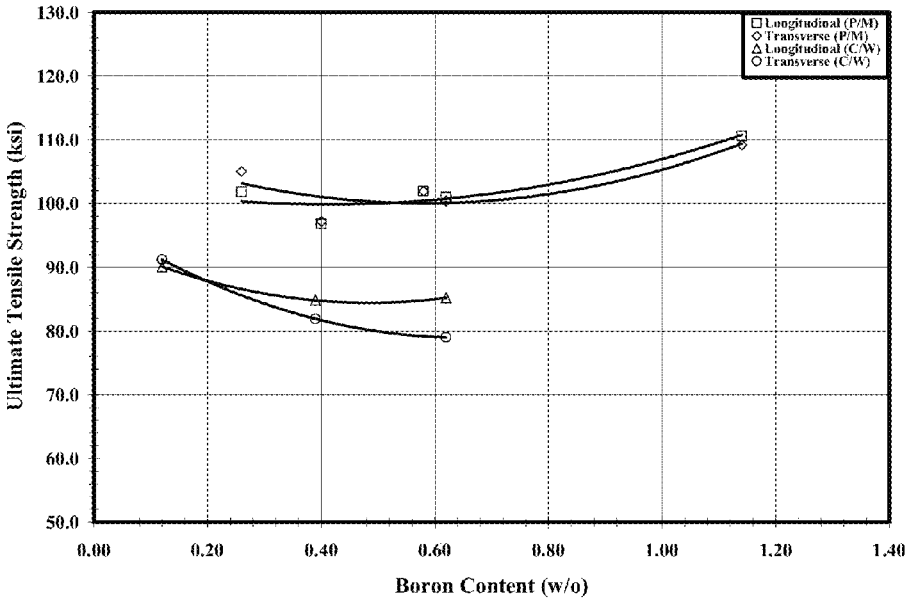
FIG. 10 shows comparative graphs of ultimate tensile strength as a function of % B.
Figure 11:
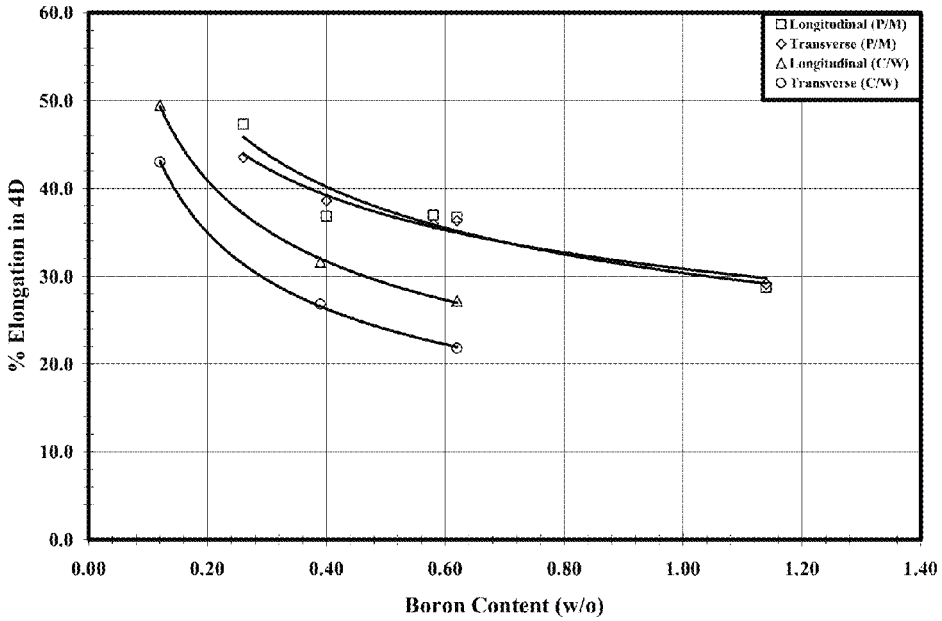
FIG. 11 shows comparative graphs of percent elongation as a function of % B.
Figure 12:
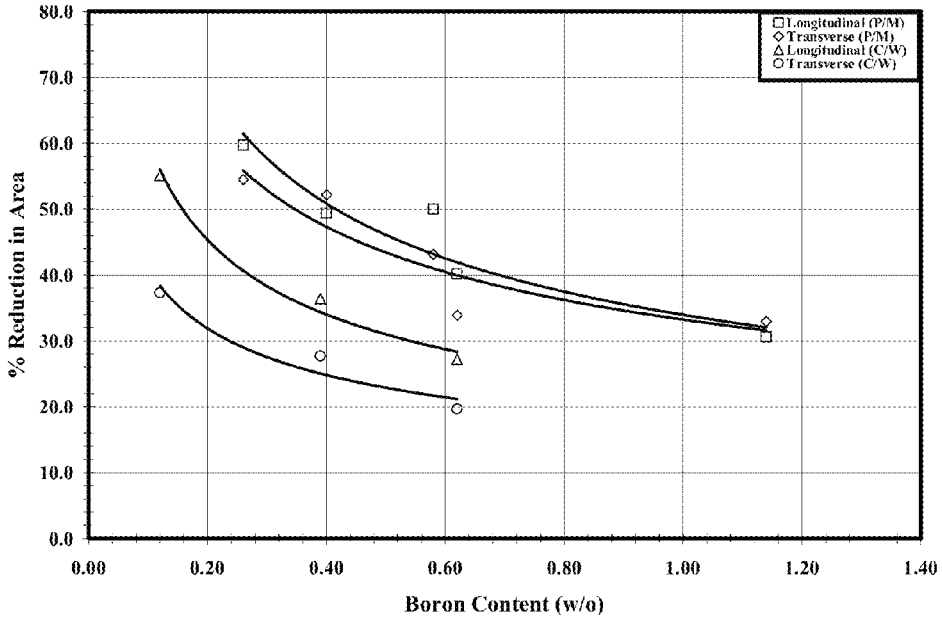
FIG. 12 shows comparative graphs of percent reduction in area as a function of % B.
Figure 13:
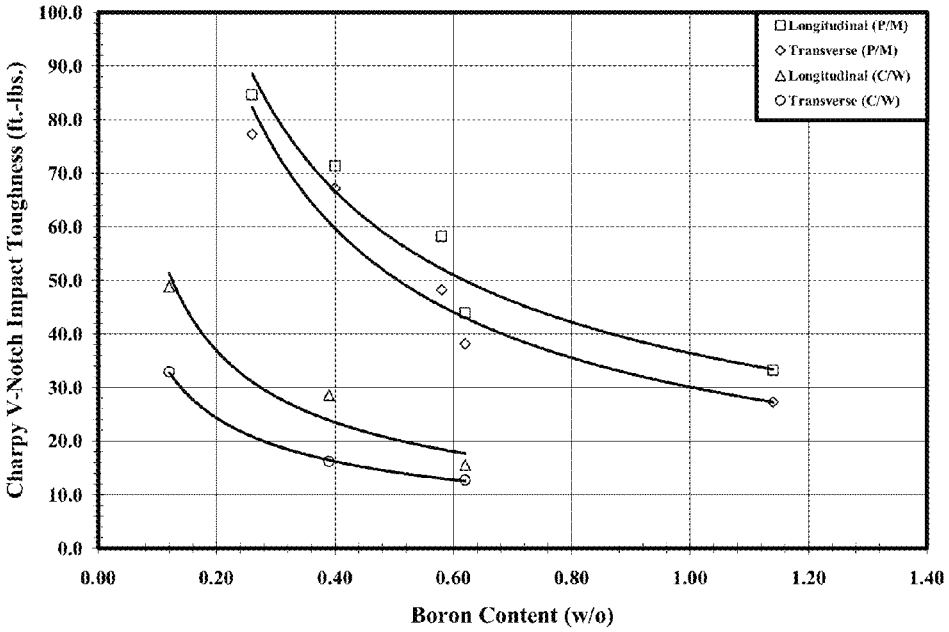
FIG. 13 shows comparative graphs of Charpy V-notch toughness as a function of % B.
Figure 14:
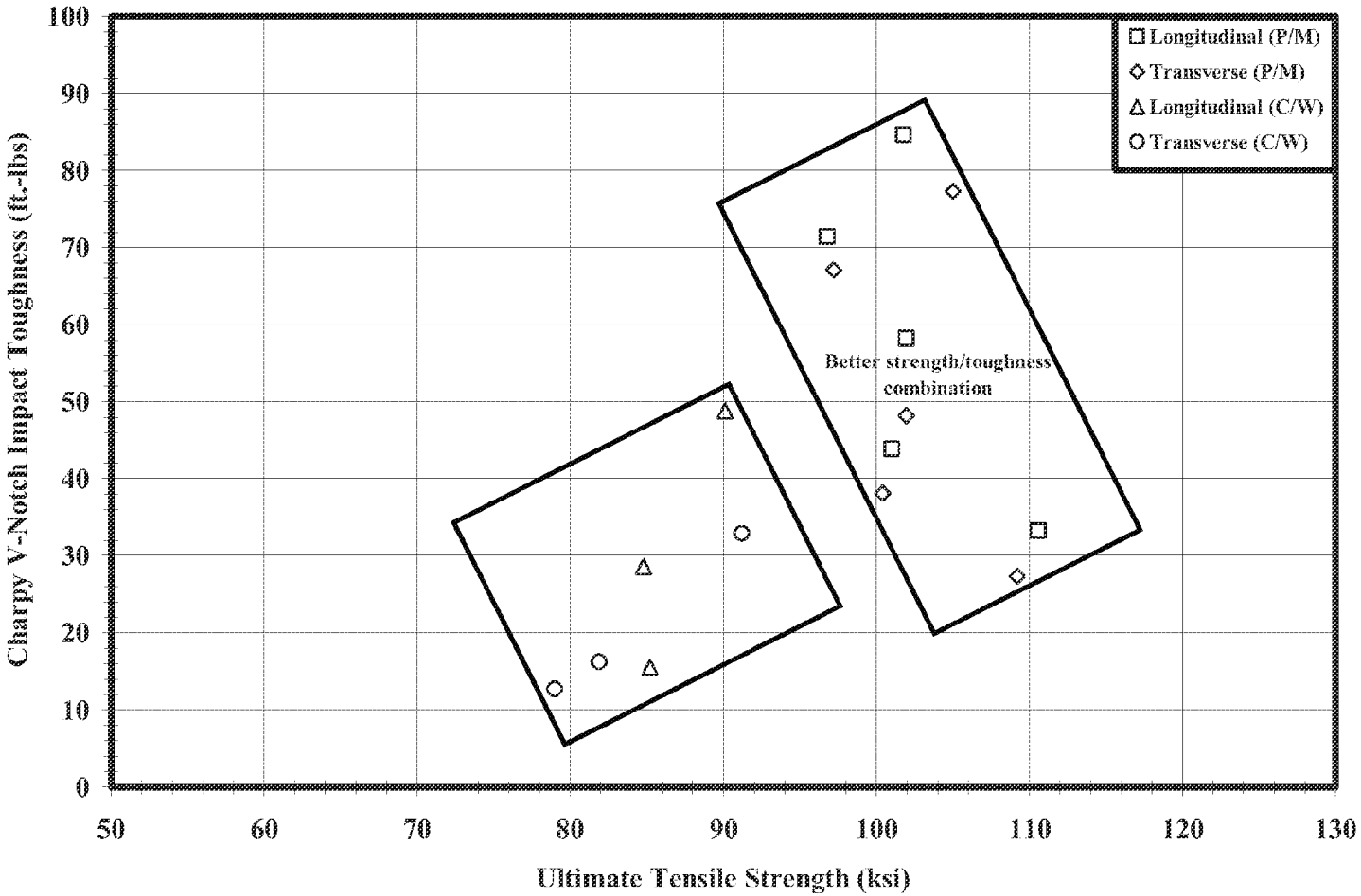
FIG. 14 shows comparative plots of Charpy V-Notch toughness as a function of ultimate tensile strength.
Figure 16A:
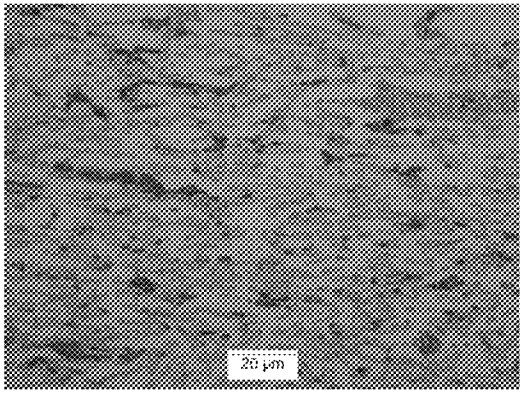
FIGS. 16A and 16B are photomicrographs of a longitudinal section showing two different regions of sample material from Heat 046 at a magnification of 500×.
Figure 16B:
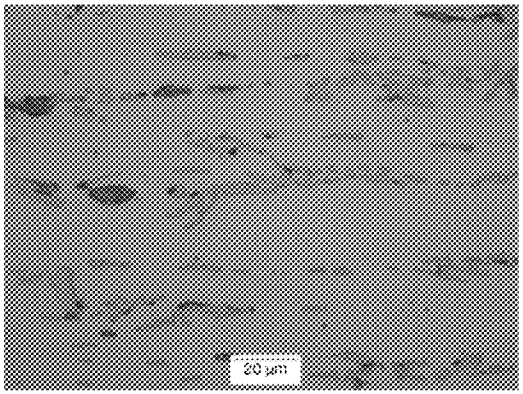
Figure 17:
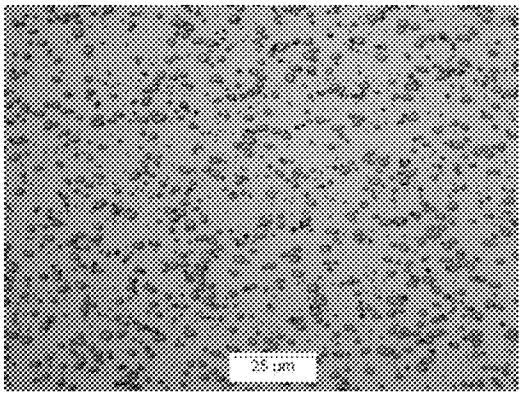
FIG. 17 is a photomicrograph of a longitudinal section of sample material from Heat 881 at a magnification of 500×.
Figure 19:
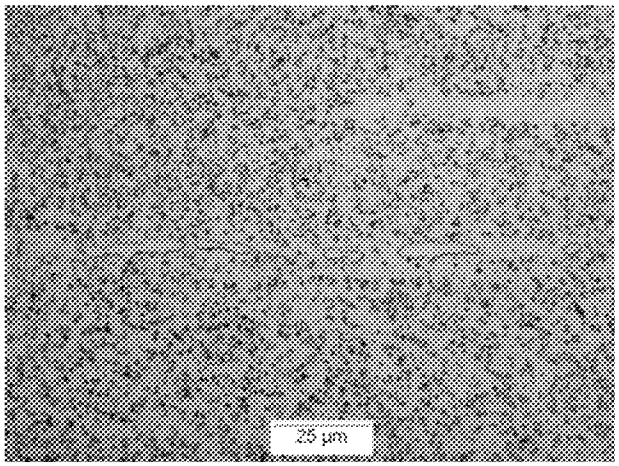
FIG. 19 is a photomicrograph of a longitudinal section of sample material from Heat 866 at a magnification of 500×.
Figure 18:
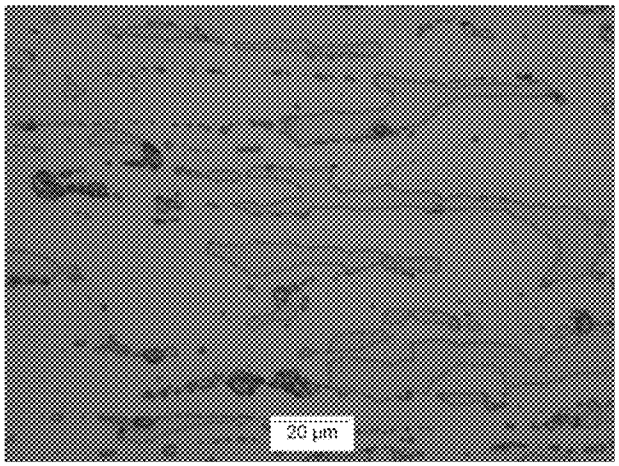
FIG. 18 is a photomicrograph of a longitudinal section of sample material from Heat 047 at a magnification of 500×.
Figure 20B:
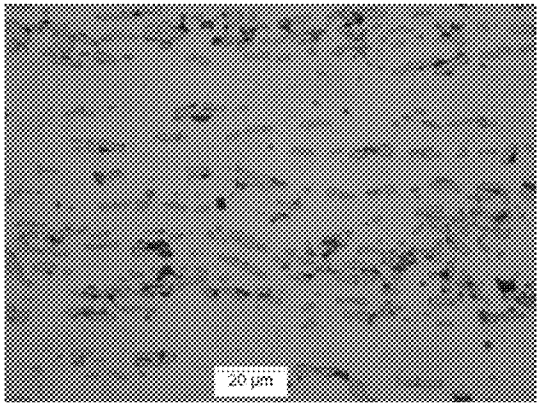
FIGS. 20A and 20B are photomicrographs of a longitudinal section showing two different regions of sample material from Heat 048 at a magnification of 500×.
Figure 20A:
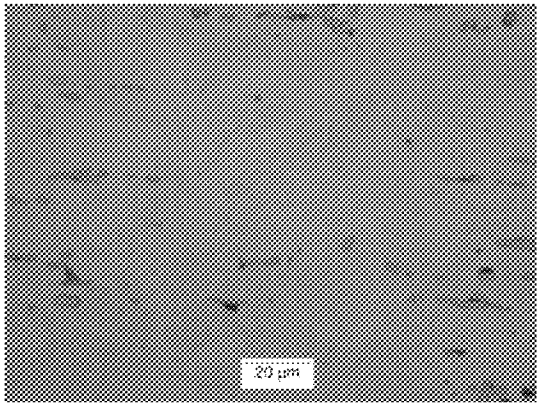
Figure 21:
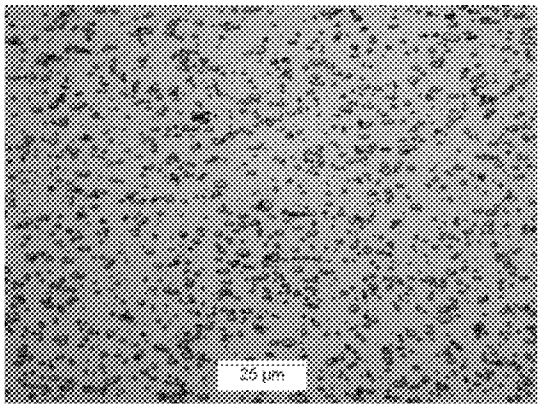
FIG. 21 is a photomicrograph of a longitudinal section of sample material from Heat 869 at a magnification of 500×.
Figure 22A:
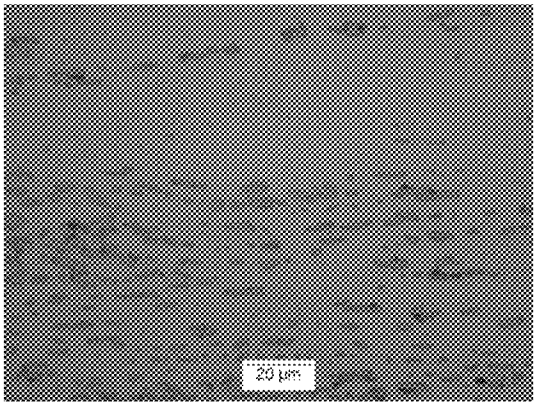
FIGS. 22A and 22B are photomicrographs of a longitudinal section showing two different regions of sample material from Heat 049 at a magnification of 500×.
Figure 22B:
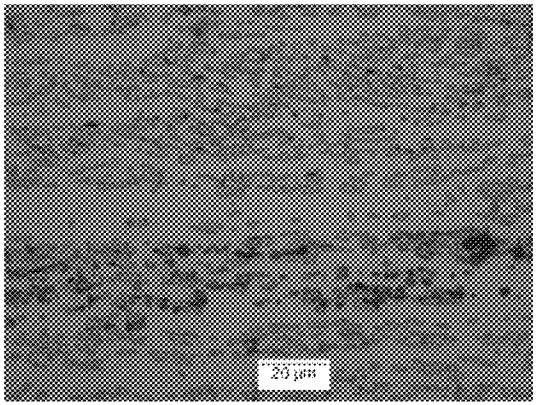
Figure 23:
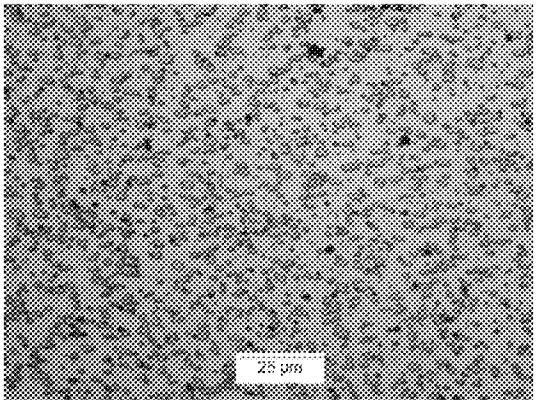
FIG. 23 is a photomicrograph of a longitudinal section of sample material from Heat 870 at a magnification of 500×.
Figure 24:
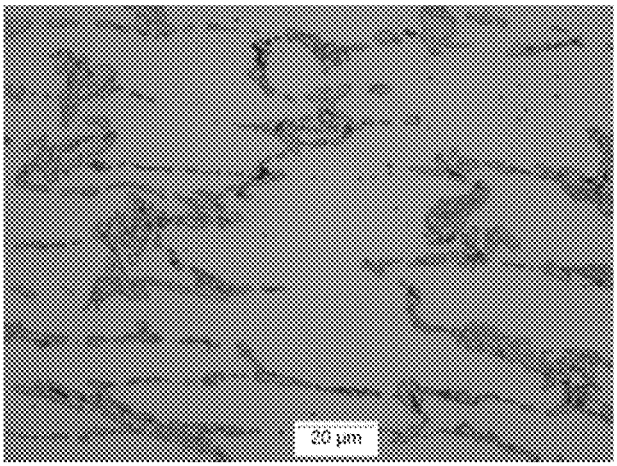
FIG. 24 is a photomicrograph of a longitudinal section of sample material from Heat 050 at a magnification of 500×.
Figure 25:
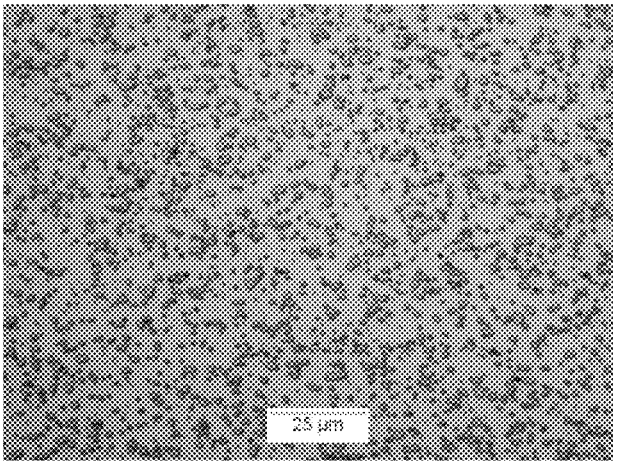
FIG. 25 is a photomicrograph of a longitudinal section of sample material from Heat 868 at a magnification of 500×.

Examination of the data in Tables IV to VIII shows that the strength, ductility, and toughness of the powder metallurgy heats are consistently better than the same properties of the cast/wrought heats. This behavior is graphically depicted in FIGS. 9 (0.2%YS), 10 (UTS), 11 (% El.), 12 (% R.A.), and 13 (CVN impact toughness). FIG. 14, which is a plot of CVN toughness versus UTS clearly shows the superior combination of strength/toughness of the powder metallurgy materials relative to the cast/wrought materials.

TABLE IV

| Heat | Composition | | | | | | | Long. Annealed Tensile Properties | | | | | |
|---|---|---|---|---|---|---|---|---|---|---|---|---|---|
| | | | | | | | | Strength (ksi) | | | NTS/UTS | Ductility | |
| Number | Cr | Ni | Mo | B | Gd | $B_{Eq}$ | Test | 0.2% YS | UTS | NTS | Ratio | % El. | % R.A. |
| 046 | 22.12 | 18.56 | 2.78 | 0.39 | 0.42 | 2.22 | 1 | 37.5 | 85.1 | 95.9 | 1.13 | 32.9 | 42.9 |
| | | | | | | | 2 | 38.4 | 85.8 | 96.8 | 1.14 | 31.2 | 36.7 |
| | | | | | | | 3 | 39.3 | 83.6 | 94.7 | 1.12 | 30.8 | 29.7 |
| | | | | | | | Avg. | 38.4 | 84.8 | 95.8 | 1.13 | 31.6 | 36.4 |
| 881 | 22.12 | 18.25 | 2.88 | 0.40 | 0.44 | 2.31 | 1 | 42.2 | 96.9 | 114.2 | 1.18 | 37.3 | 51.1 |
| | | | | | | | 2 | 42.5 | 96.9 | 115.1 | 1.19 | 35.4 | 48.8 |
| | | | | | | | 3 | 43.4 | 96.7 | 115.7 | 1.19 | 37.7 | 48.4 |
| | | | | | | | Avg. | 42.7 | 96.8 | 115.0 | 1.19 | 36.8 | 49.4 |
| 047 | 18.12 | 10.35 | 4.13 | 0.12 | 0.32 | 1.51 | 1 | 40.1 | 90.2 | 112.0 | 1.24 | 49.7 | 56.3 |
| | | | | | | | 2 | 40.0 | 90.7 | 109.9 | 1.22 | 50.7 | 59.9 |
| | | | | | | | 3 | 42.6 | 89.5 | 110.7 | 1.23 | 48.0 | 49.1 |
| | | | | | | | Avg. | 40.9 | 90.1 | 110.9 | 1.23 | 49.5 | 55.1 |
| 866 | 18.16 | 10.16 | 4.22 | 0.26 | 0.27 | 1.43 | 1 | 41.0 | 101.9 | 125.8 | 1.24 | 48.6 | 66.6 |
| | | | | | | | 2 | 41.7 | 101.9 | 120.4 | 1.18 | 47.2 | 59.2 |
| | | | | | | | 3 | 41.5 | 101.6 | 121.1 | 1.19 | 46.1 | 53.4 |
| | | | | | | | Avg. | 41.4 | 101.8 | 122.4 | 1.20 | 47.3 | 59.7 |

TABLE V

| Heat | Composition | | | | | | | Trans. Annealed Tensile Properties | | | | | |
|---|---|---|---|---|---|---|---|---|---|---|---|---|---|
| | | | | | | | | Strength | | | NTS/UTS | Ductility | |
| Number | Cr | Ni | Mo | B | Gd | $B_{Eq}$ | Test # | 0..2% YS | UTS | NTS | Ratio | % El | % R.A. |
| 046 | 22.12 | 18.56 | 2.78 | 0.39 | 0.42 | 2.22 | 1 | 37.5 | 81.8 | 93.8 | 1.15 | 24.9 | 25.5 |
| | | | | | | | 2 | 38.4 | 82.3 | 90.6 | 1.11 | 27.8 | 28.8 |
| | | | | | | | 3 | 37.9 | 81.6 | 91.6 | 1.12 | 27.8 | 28.8 |
| | | | | | | | Avg. | 37.9 | 81.9 | 92.0 | 1.12 | 26.8 | 27.7 |
| 881 | 22.12 | 18.25 | 2.88 | 0.40 | 0.44 | 2.31 | 1 | 43.7 | 97.0 | 113.7 | 1.17 | 39.0 | 55.2 |
| | | | | | | | 2 | 43.0 | 97.3 | 113.6 | 1.17 | 39.5 | 55.1 |
| | | | | | | | 3 | 42.9 | 97.4 | 114.3 | 1.18 | 37.3 | 46.2 |
| | | | | | | | Avg. | 43.2 | 97.2 | 113.9 | 1.17 | 38.6 | 52.2 |
| 047 | 18.12 | 10.35 | 4.13 | 0.12 | 0.32 | 1.51 | 1 | 42.0 | 91.0 | 109.8 | 1.20 | 45.5 | 42.7 |
| | | | | | | | 2 | 42.1 | 91.2 | 108.2 | 1.19 | 42.4 | 33.3 |
| | | | | | | | 3 | 42.9 | 91.3 | 107.6 | 1.18 | 41.1 | 35.8 |
| | | | | | | | Avg. | 42.3 | 91.2 | 108.5 | 1.19 | 43.0 | 37.3 |
| 866 | 18.16 | 10.16 | 4.22 | 0.26 | 0.27 | 1.43 | 1 | 53.5 | 105.7 | 116.1 | 1.11 | 34.6 | 34.3 |
| | | | | | | | 2 | 48.4 | 104.2 | 114.3 | 1.09 | 48.2 | 64.6 |
| | | | | | | | 3 | 49.7 | 105.1 | 116.5 | 1.11 | 47.7 | 64.7 |
| | | | | | | | Avg. | 50.5 | 105.0 | 115.6 | 1.10 | 43.5 | 54.5 |

TABLE VI

| Heat | Composition | | | | | | | Long. Annealed Tensile Properties | | | | | |
|---|---|---|---|---|---|---|---|---|---|---|---|---|---|
| | | | | | | | | Strength | | | NTS/UTS | Ductility | |
| Number | Cr | Ni | Mo | B | Gd | $B_{Eq}$ | Test | 0..2% YS | UTS | NTS | Ratio | % El | % R.A. |
| 048 | 20.22 | 11.62 | 0.06 | 0.62 | 0.79 | 4.06 | 1 | 37.9 | 84.3 | 84.7 | 0.99 | 30.0 | 29.1 |
| | | | | | | | 2 | 39.9 | 85.3 | 84.8 | 1.00 | 25.0 | 24.7 |
| | | | | | | | 3 | 38.1 | 85.9 | 85.1 | 1.00 | 26.5 | 27.9 |
| | | | | | | | Avg. | 38.6 | 85.2 | 84.9 | 1.00 | 27.2 | 27.2 |
| 869 | 20.44 | 11.73 | 0.11 | 0.62 | 0.66 | 3.49 | 1 | 37.5 | 101.3 | 102.0 | 1.01 | 38.4 | 42.4 |
| | | | | | | | 2 | 37.2 | 100.6 | 101.0 | 1.00 | 33.7 | 29.8 |
| | | | | | | | 3 | 36.9 | 101.0 | 101.3 | 1.00 | 38.1 | 48.4 |
| | | | | | | | Avg. | 37.2 | 101.0 | 101.4 | 1.00 | 36.7 | 40.2 |
| 049 | 20.66 | 11.64 | <0.01 | 1.10 | 0.46 | 3.10 | | (Could not be tested, ¾" plate had too many hot tears) | | | | | |
| 870 | 20.76 | 11.64 | <0.01 | 1.14 | 0.54 | 3.49 | 1 | 43.9 | 110.6 | 109.6 | 0.99 | 30.1 | 34.3 |
| | | | | | | | 2 | 44.3 | 110.7 | 109.5 | 0.99 | 27.3 | 27.0 |
| | | | | | | | 3 | 44.2 | 110.4 | 109.7 | 0.99 | 28.8 | 30.4 |
| | | | | | | | Avg. | 44.1 | 110.6 | 109.6 | 0.99 | 28.7 | 30.6 |
| 050 | 20.34 | 15.14 | 4.05 | 0.54 | 0.33 | 1.98 | | (Could not be tested, billet broke-up on first pass to plate) | | | | | |
| 868 | 20.52 | 15.16 | 4.13 | 0.58 | 0.26 | 1.71 | 1 | 44.5 | 102.0 | 119.1 | 1.17 | 37.9 | 52.7 |
| | | | | | | | 2 | 45.3 | 101.9 | 119.0 | 1.17 | 37.3 | 52.7 |
| | | | | | | | 3 | 41.3 | 101.9 | 119.6 | 1.17 | 35.6 | 44.6 |
| | | | | | | | Avg. | 43.7 | 101.9 | 119.2 | 1.17 | 36.9 | 50.0 |

TABLE VII

| Heat | Composition | | | | | | | Trans. Annealed Tensile Properties | | | | | |
|---|---|---|---|---|---|---|---|---|---|---|---|---|---|
| | | | | | | | | Strength | | | NTS/UTS | Ductility (%) | |
| Number | Cr | Ni | Mo | B | Gd | $B_{Eq}$ | Test | 0.2% YS | UTS | NTS | Ratio | % El | % R.A. |
| 048 | 20.22 | 11.62 | 0.06 | 0.62 | 0.79 | 4.06 | 1 | 38.5 | 80.1 | 82.1 | 1.04 | 29.0 | 20.7 |
| | | | | | | | 2 | 36.6 | 77.5 | 82.1 | 1.04 | 16.8 | 16.3 |
| | | | | | | | 3 | 38.6 | 79.4 | 83.1 | 1.05 | 19.6 | 22.2 |
| | | | | | | | Avg. | 37.9 | 79.0 | 82.4 | 1.04 | 21.8 | 19.7 |
| 869 | 20.44 | 11.73 | 0.11 | 0.62 | 0.66 | 3.49 | 1 | 37.9 | 100.5 | 98.3 | 0.98 | 36.4 | 27.9 |
| | | | | | | | 2 | 37.9 | 100.5 | 99.5 | 0.99 | 36.4 | 36.7 |
| | | | | | | | 3 | 37.2 | 100.3 | 97.1 | 0.97 | 36.2 | 37.0 |
| | | | | | | | Avg. | 37.7 | 100.4 | 98.3 | 0.98 | 36.3 | 33.9 |
| 049 | 20.66 | 11.64 | <0.01 | 1.10 | 0.46 | 3.10 | | (Could not be tested, ¾" plate had too many hot tears) | | | | | |
| 870 | 20.76 | 11.64 | <0.01 | 1.14 | 0.54 | 3.49 | 1 | 43.7 | 109.3 | 107.2 | 0.98 | 30.8 | 36.2 |
| | | | | | | | 2 | 44.4 | 109.2 | 106.8 | 0.98 | 27.6 | 30.9 |
| | | | | | | | 3 | 43.7 | 109.0 | 107.7 | 0.99 | 28.8 | 31.5 |
| | | | | | | | Avg. | 43.9 | 109.2 | 107.2 | 0.98 | 29.1 | 32.9 |

TABLE VII-continued

| Heat | Composition | | | | | | | Trans. Annealed Tensile Properties | | | | | |
|---|---|---|---|---|---|---|---|---|---|---|---|---|---|
| | | | | | | | | Strength | | | NTS/UTS | Ductility (%) | |
| Number | Cr | Ni | Mo | B | Gd | $B_{Eq}$ | Test | 0.2% YS | UTS | NTS | Ratio | % El | % R.A. |
| 050 | 20.34 | 15.14 | 4.05 | 0.54 | 0.33 | 1.98 | (Could not be tested, billet broke-up on first pass to plate) | | | | | | |
| 868 | 20.52 | 15.16 | 4.13 | 0.58 | 0.26 | 1.71 | 1 | 47.0 | 101.8 | 118.3 | 1.16 | 35.5 | 40.8 |
| | | | | | | | 2 | 46.1 | 101.8 | 115.1 | 1.13 | 35.4 | 43.1 |
| | | | | | | | 3 | 46.2 | 102.2 | 115.2 | 1.13 | 36.9 | 45.5 |
| | | | | | | | Avg. | 46.4 | 101.9 | 116.2 | 1.14 | 35.9 | 43.1 |

TABLE VIII

| CVN Impact Toughness | | | | | | | |
|---|---|---|---|---|---|---|---|
| Heat | B | Gd | Orientation | #1 | #2 | #3 | Avg. |
| 046 | 0.39 | 0.42 | L-S | 30.5 | 24.2 | 31.0 | 28.6 |
| | | | T-L | 14.2 | 17.4 | 16.9 | 16.2 |
| 881 | 0.40 | 0.44 | L-S | 72.3 | 70.9 | 70.9 | 71.4 |
| | | | T-L | 67.7 | 68.5 | 65.2 | 67.1 |
| 047 | 0.12 | 0.32 | L-S | 47.4 | 48.9 | 50.1 | 48.8 |
| | | | T-L | 32.2 | 33.3 | 33.3 | 32.9 |
| 866 | 0.26 | 0.27 | L-S | 85.5 | 87.3 | 81.0 | 84.6 |
| | | | T-L | 77.3 | 72.7 | 81.8 | 77.3 |
| 048 | 0.62 | 0.79 | L-S | 15.7 | 15.2 | 15.7 | 15.5 |
| | | | T-L | 12.5 | 12.9 | 12.6 | 12.7 |

TABLE VIII-continued

| CVN Impact Toughness | | | | | | | |
|---|---|---|---|---|---|---|---|
| Heat | B | Gd | Orientation | #1 | #2 | #3 | Avg. |
| 869 | 0.62 | 0.66 | L-S | 43.9 | 43.7 | 44.2 | 43.9 |
| | | | T-L | 37.7 | 38.5 | 38.1 | 38.1 |
| 049 | 1.10 | 0.46 | (Could not be tested, ¾" plate had too many hot tears) | | | | |
| 870 | 1.14 | 0.54 | L-S | 33.0 | 34.5 | 32.2 | 33.2 |
| | | | T-L | 27.3 | 27.2 | 27.4 | 27.3 |
| 050 | 0.54 | 0.33 | (Could not be tested, billet broke-up on first pass to plate) | | | | |
| 868 | 0.58 | 0.26 | L-S | 58.0 | 59.1 | 57.5 | 58.2 |
| | | | T-L | 47.3 | 47.6 | 49.8 | 48.2 |

TABLE IX

| Heat | Composition (w/o) | | | | | | | Corrosion Test Results | | | | | | | |
|---|---|---|---|---|---|---|---|---|---|---|---|---|---|---|---|
| | | | | | | | | Test Data (mpy) | | | | | Average Rate | | |
| Number | Cr | Ni | Mo | B | Gd | $B_{Eq}$ | Test # | Rate #1 | Rate #2 | Rate #3 | Rate #4 | Rate #5 | mpy | ipm | Comments |
| 046 | 22.12 | 18.56 | 2.78 | 0.39 | 0.42 | 2.22 | 1 | 24.5 | 82.5 | 203.7 | 384.5 | 448.5 | 228.7 | 0.0191 | Heavy uniform |
| | | | | | | | 2 | 24.5 | 83.4 | 199.2 | 378.5 | 468.3 | 230.8 | 0.0192 | attack on all |
| | | | | | | | 3 | 23.8 | 75.3 | 183.6 | 354.1 | 466.8 | 220.7 | 0.0184 | surfaces |
| 881 | 22.12 | 18.25 | 2.88 | 0.40 | 0.44 | 2.31 | 1 | 6.3 | 4.1 | 4.4 | 5.4 | 5.7 | 5.2 | 0.0004 | Light uniform |
| | | | | | | | 2 | 6.7 | 4.4 | 4.4 | 4.8 | 5.4 | 5.1 | 0.0004 | general attack |
| | | | | | | | 3 | 6.3 | 4.1 | 4.4 | 5.0 | 5.0 | 5.0 | 0.0004 | on all surfaces |
| 047 | 18.12 | 10.35 | 4.13 | 0.12 | 0.32 | 1.51 | 1 | 65.6 | 911.5 | 1068 | 1098 | 1112 | 851.0 | 0.0709 | Heavy uniform |
| | | | | | | | 2 | 59.5 | 878.5 | 1033 | 1079 | 1119 | 833.8 | 0.0695 | attack on all |
| | | | | | | | 3 | 55.5 | 812.0 | 1047 | 1094 | 1085 | 818.7 | 0.0682 | surfaces |
| 866 | 18.16 | 10.16 | 4.22 | 0.26 | 0.27 | 1.43 | 1 | 10.3 | 11.6 | 19.6 | 28.4 | 39.4 | 21.9 | 0.0018 | Moderate |
| | | | | | | | 2 | 9.3 | 11.4 | 17.9 | 28.2 | 37.6 | 20.9 | 0.0017 | uniform |
| | | | | | | | 3 | 10.4 | 11.0 | 18.6 | 27.8 | 39.4 | 21.4 | 0.0018 | general attack on all surfaces |

mpy = mils per year
ipm = inches per month

TABLE X

| Heat | Composition (w/o) | | | | | | | Huey Corrosion Test Results | | | | | | | |
|---|---|---|---|---|---|---|---|---|---|---|---|---|---|---|---|
| | | | | | | | | Test Data (mpy) | | | | | Average Rate | | |
| Number | Cr | Ni | Mo | B | Gd | $B_{Eq}$ | Test # | Rate #1 | Rate #2 | Rate #3 | Rate #4 | Rate #5 | mpy | ipm | Comments |
| 048 | 20.22 | 11.62 | 0.06 | 0.62 | 0.79 | 4.06 | 1 | 136.5 | 454.4 | 878.1 | 941.7 | 909.0 | 663.9 | 0.0553 | Heavy uniform |
| | | | | | | | 2 | 123.2 | 388.4 | 760.1 | 1185 | 936.0 | 678.5 | 0.0565 | attack on all |
| | | | | | | | 3 | 134.1 | 452.6 | 848.5 | 777.4 | 831.4 | 608.8 | 0.0507 | surfaces |
| 869 | 20.44 | 11.73 | 0.11 | 0.62 | 0.66 | 3.49 | 1 | 11.1 | 7.1 | 8.5 | 9.9 | 10.4 | 9.4 | 0.0008 | Light uniform |
| | | | | | | | 2 | 12.2 | 8.5 | 8.6 | 9.4 | 9.8 | 9.7 | 0.0008 | general attack |
| | | | | | | | 3 | 11.7 | 7.0 | 8.7 | 9.2 | 9.5 | 9.2 | 0.0008 | on all surfaces |
| 049 | 20.66 | 11.64 | <0.01 | 1.10 | 0.46 | 3.10 | 1, 2 & 3 | Could not be tested, ¾" plate had too many hot tears | | | | | | | |
| 870 | 20.76 | 11.64 | <0.01 | 1.14 | 0.54 | 3.49 | 1 | 17.5 | 18.0 | 18.7 | 20.5 | 20.4 | 19.0 | 0.0016 | Moderate |
| | | | | | | | 2 | 17.5 | 17.6 | 19.3 | 20.0 | 20.9 | 19.1 | 0.0016 | uniform general |
| | | | | | | | 3 | 17.3 | 18.0 | 19.2 | 20.3 | 20.3 | 19.0 | 0.0016 | attack on all surfaces |

TABLE X-continued

| Heat | Composition (w/o) | | | | | | | Huey Corrosion Test Results | | | | | | | |
|---|---|---|---|---|---|---|---|---|---|---|---|---|---|---|---|
| | | | | | | | | Test Data (mpy) | | | | | Average Rate | | |
| Number | Cr | Ni | Mo | B | Gd | $B_{Eq}$ | Test # | Rate #1 | Rate #2 | Rate #3 | Rate #4 | Rate #5 | mpy | ipm | Comments |
| 050 | 20.34 | 15.14 | 4.05 | 0.54 | 0.33 | 1.98 | 1, 2 & 3 | Could not be tested, billet broke-up on first pass to plate | | | | | | | |
| 868 | 20.52 | 15.16 | 4.13 | 0.58 | 0.26 | 1.71 | 1 | 9.6 | 8.4 | 11.8 | 17.0 | 19.4 | 13.2 | 0.0011 | Light uniform |
| | | | | | | | 2 | 9.3 | 8.4 | 11.1 | 17.3 | 20.2 | 13.3 | 0.0011 | general attack |
| | | | | | | | 3 | 9.7 | 8.4 | 12.0 | 17.3 | 20.3 | 13.5 | 0.0011 | on all surfaces |

mpy = mils per year
ipm = inches per month

Figure 15:
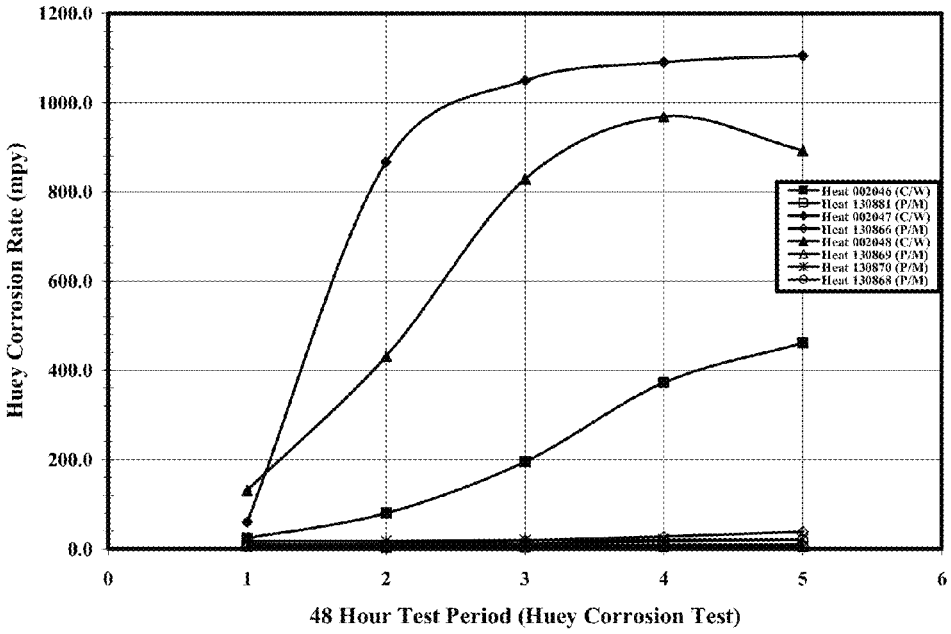
FIG. 15 shows comparative graphs of Huey corrosion rate as a function of time.

The results of the Huey corrosion testing set forth in Tables IX (cast/wrought heats) and X (powder metallurgy heats) show pronounced and significant differences between the two types of material. In all cases the Huey corrosion rates of the powder metallurgy material are lower and more stable (i.e., the corrosion rate does not increase appreciably with successive 5 hour test periods). The significant difference in corrosion behavior between the powder metallurgy heats and the cast/wrought heats is graphically depicted in FIG. 15. That difference is completely unexpected since the two sets of heats do not appear to differ significantly with respect to alloy composition. It should also be noted that of the three cast/wrought heats that could be tested, Heat 047 exhibited the worst Huey corrosion rate, and that behavior is attributed to the observed presence of ferrite in the matrix material of the alloy.

The metallographic results presented in FIGS. 16-25 qualitatively show the differences in the size and distribution of the second phase boride and gadolinide particles between the cast/wrought heats (FIGS. 16A, 16B, 18, 20A, 20B, 22A, 22B, and 24) and the powder metallurgy processed heats (FIGS. 17, 19, 21, 23, and 25). Compared to the cast/wrought heats, the annealed microstructures of the powder metallurgy heats show smaller and more uniformly distributed borides and gadolinides without pronounced alloy segregation.

It will be recognized by those skilled in the art that changes or modifications may be made to the above-described embodiments without departing from the broad inventive concepts of the invention. It is understood, therefore, that the invention is not limited to the particular embodiments that are described, but is intended to cover all modifications and changes within the scope and spirit of the invention as described above and set forth in the appended claims.

The invention claimed is:

1. A corrosion resistant, thermal neutron absorbing alloy powder having the following composition in weight percent,

| | |
|---|---|
| Carbon | not more than about 0.08 |
| Manganese | up to about 3 |
| Silicon | up to about 2 |
| Chromium | about 17 to about 27 |
| Nickel | about 11 to about 20 |
| Mo + (W/1.92) | up to about 5.2 |
| Boron | at least about 0.25 |
| Gadolinium | at least about 0.05 |
| Oxygen | about 0.01 to about 0.1 |
| Nitrogen | up to 0.2 |

wherein $B_{Eq}$=% boron+(4.35×% gadolinium), $0.78 \leq B_{Eq} \leq 13.0$, and the balance of the alloy powder composition is iron and usual impurities, wherein the impurities include 0.05% max. phosphorus, 0.03% max. sulfur, less than 0.005% yttrium, and less than 0.01% aluminum.

2. An alloy powder as claimed in claim 1 which contains not more than about 2.6% gadolinium.

3. An alloy powder as claimed in claim 1 which contains not more than about 2.5% boron.

4. An alloy powder as claimed in claim 1 wherein Mo+(W/1.92) is at least about 2.8%.

5. An alloy powder as claimed in claim 1 wherein Mo+(W/1.92) is not more than about 0.5%.

6. An alloy powder as claimed in claim 1 which contains not more than about 1.0% boron and $B_{Eq}$ is not more than about 12.0%.

7. An alloy powder as claimed in claim 1 which contains not more than about 2.0% boron.

8. An alloy powder as claimed in claim 7 which contains not more than about 0.25% gadolinium.

9. An alloy powder as claimed in claim 1 which contains at least about 0.12% gadolinium.

10. An alloy powder as claimed in claim 9 which contains not more than about 2.6% gadolinium.

11. An alloy powder as claimed in claim 1 which contains at least about 300 ppm nitrogen.

12. An alloy powder as claimed in claim 1 which contains not more than about 0.05% carbon.

13. An article of manufacture that provides good processability in combination with good mechanical and corrosion resistance properties, said article being formed from consolidated austenitic alloy powder having the following composition in weight percent,

| | |
|---|---|
| Carbon | not more than about 0.08 |
| Manganese | up to about 3 |
| Silicon | up to about 2 |
| Chromium | about 17 to about 27 |
| Nickel | about 11 to about 20 |
| Mo + (W/1.92) | up to about 5.2 |
| Boron | at least about 0.25 |
| Gadolinium | at least about 0.05 |
| Oxygen | about 0.01 to about 0.1 |
| Nitrogen | up to 0.2 |

wherein $B_{Eq}$=% boron+(4.35×% gadolinium), $0.78 \leq B_{Eq} \leq 13.0$, and the balance of the alloy powder composition is iron and usual impurities, wherein the impurities include 0.05% max. phosphorus, 0.03% max. sulfur, less than 0.005% yttrium, and less than 0.01% aluminum, and the article comprises a matrix and a plurality of boride and gadolinide particles dispersed within the matrix, said boride and gadolinide particles are predominantly $M_2B$, $M_3B_2$, $M_5X$, and $M_3X$ in form, where X is gadolinium or a combination of gadolinium and boron and M is one or more of the elements silicon, chromium, nickel, molybdenum, and iron.

14. An article as claimed in claim 13 wherein the alloy powder contains not more than about 0.05% carbon.

15. An article as claimed in claim 13 wherein the alloy powder contains at least about 0.12% gadolinium.

16. An article as claimed in claim 15 wherein the alloy powder contains not more than about 2.6% gadolinium.

17. An article as claimed in claim 13 wherein the alloy powder contains not more than about 2.0% boron.

18. An article as claimed in claim 13 wherein % Mo+(% W/1.92) in the alloy powder is at least about 2.8%.

19. An article as claimed in claim 13 wherein % Mo+(% W/1.92) in the alloy powder is not more than about 0.5%.

20. An article as claimed in claim 13 wherein the alloy powder contains not more than about 1.0% boron and $B_{Eq}$ is not more than about 12.0%.

21. An article as claimed in claim 20 wherein the average area fraction of the borides and gadolinides is not more than about 20%.

22. An article as claimed in claim 13 wherein the average area fraction of the borides and gadolinides is not more than about 22% and the alloy powder contains not more than about 2% boron and not more than about 0.25% gadolinium.

23. An article as claimed in claim 13 wherein the alloy powder contains not more than about 1.0% boron.

24. An article as claimed in claim 23 wherein the alloy powder contains at least about 0.12% gadolinium.

25. An article as claimed in claim 24 wherein the alloy powder contains not more than about 2.6% gadolinium.

* * * * *